US010144055B2

(12) United States Patent
Kurashita et al.

(10) Patent No.: US 10,144,055 B2
(45) Date of Patent: Dec. 4, 2018

(54) DEVICE FOR CASTING CYLINDER HEAD AND METHOD FOR CASTING CYLINDER HEAD

(71) Applicant: Nissan Motor Co., Ltd., Yokohama-shi, Kanagawa (JP)

(72) Inventors: Tatsu Kurashita, Kanagawa (JP); Kenji Mizukoshi, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 15/569,799

(22) PCT Filed: May 29, 2015

(86) PCT No.: PCT/JP2015/065511

§ 371 (c)(1),
(2) Date: Oct. 27, 2017

(87) PCT Pub. No.: WO2016/194031

PCT Pub. Date: Dec. 8, 2016

(65) Prior Publication Data

US 2018/0141111 A1 May 24, 2018

(51) Int. Cl.
*B22C 9/24* (2006.01)
*B22C 9/06* (2006.01)
(Continued)

(52) U.S. Cl.
CPC ..... *B22C 9/24* (2013.01); *B22C 9/064* (2013.01); *B22C 9/108* (2013.01); *B22D 18/04* (2013.01); *F02F 1/24* (2013.01)

(58) Field of Classification Search
CPC ..... B22C 9/064; B22C 9/108; B22C 9/24; B22D 18/04; F02F 1/24
(Continued)

(56) References Cited

U.S. PATENT DOCUMENTS

| | | | |
|---|---|---|---|
| 8,434,546 | B1 | 5/2013 | Heitkamp et al. |
| 2006/0108084 | A1 | 5/2006 | Bassi |
| 2006/0157217 | A1 | 7/2006 | Bassi |

FOREIGN PATENT DOCUMENTS

| | | | |
|---|---|---|---|
| CN | 1671493 | A | 9/2005 |
| CN | 1802227 | A | 7/2006 |

(Continued)

*Primary Examiner* — Kevin P Kerns
(74) *Attorney, Agent, or Firm* — Global IP Counselors, LLP

(57) ABSTRACT

A multi-cylinder head casting device includes a casting mold and a port core. The casting mold includes dies that define a cavity corresponding to an outer shape of a cylinder head. The port core includes body parts for forming the ports, and a base part connecting the body parts. A lower die has intake and exhaust hole formation surfaces on the combustion chamber side of the port, and a port core support surface corresponding to the mounting surface of the cylinder head. Side dies have a port core pressing surface that faces the port core support surface. The port core is supported inside the cavity by distal ends of the body parts contacting the air intake and exhaust hole formation surfaces. A lower surface of the base part contacts the port core support surface, and an upper surface of the base part contacts the port core pressing surface.

16 Claims, 17 Drawing Sheets

(51) Int. Cl.
*B22C 9/10* (2006.01)
*B22D 18/04* (2006.01)
*F02F 1/24* (2006.01)

(58) Field of Classification Search
USPC ..... 164/137, 340, 341, 342, 369
See application file for complete search history.

(56) References Cited

FOREIGN PATENT DOCUMENTS

| | | | | | |
|---|---|---|---|---|---|
| CN | 101400462 | A | | 4/2009 | |
| CN | 102641996 | A | | 8/2012 | |
| DE | 20221850 | | | 12/2008 | |
| JP | 63-25238 | U | | 2/1988 | |
| JP | 5-253663 | A | | 10/1993 | |
| JP | 7-266020 | A | | 10/1995 | |
| JP | 2001-286984 | A | | 10/2001 | |
| JP | 2003-39137 | A | | 2/2003 | |
| JP | 2008-229645 | A | | 10/2008 | |
| JP | 2011-140061 | A | | 7/2011 | |
| JP | 2012-20320 | A | * | 2/2012 | ..... B22C 9/10 |
| JP | 2013-176784 | A | | 9/2013 | |
| JP | 2015-80801 | A | * | 4/2015 | ..... B22C 9/10 |

* cited by examiner

DEVICE FOR CASTING CYLINDER HEAD AND METHOD FOR CASTING CYLINDER HEAD

CROSS-REFERENCE TO RELATED APPLICATIONS

This application is a U.S. National stage application of International Application No. PCT/JP2015/065511, filed May 29, 2015.

BACKGROUND

Field of the Invention

The present invention relates to a device for casting a cylinder head of an internal combustion engine, and a method for casting a cylinder head.

Background Information

A technique is known, in which, in a casting mold used when casting a cylinder head of an internal combustion engine, a clamp member is moved back and forth in conjunction with an approaching/separating motion between side dies, to position and press a port core against a lower die when completing mold clamping between the side dies with each other (refer to Japanese Laid-Open Patent Application No. Heisei 5 [1993]-253663—Patent Document 1).

SUMMARY

In the above-described technique, resin gas, and the like, generated from the port core enters the moving mechanism that moves the clamp member back and forth and becomes stiff, resulting in the occurrence of a defect in the operation of the moving mechanism. In this case, there is the problem that the clamp member is unable to sufficiently press the port core to the lower die and the port core is moved slightly, resulting in a reduction of the positioning accuracy of the port core.

The problem to be solved by the present invention is to provide a device for casting a cylinder head and a method for casting a cylinder head that are capable of suppressing a reduction in the positioning accuracy of a casting core.

The present invention solves the problem described above by supporting the casting core inside a cavity that is defined inside a casting mold, in a state in which the distal end of a body part of a casting core is placed in contact with a first surface of a lower die, the lower surface of a base part of the casting core is placed in contact with a second surface of the lower die, and the upper surface of the base part is placed in contact with a third surface of a side die.

According to the present invention, a casting core is supported, in a state in which the distal end of a body part of the casting core is placed in contact with a first surface of a lower die, the lower surface of a base part of the casting core is placed in contact with a second surface of the lower die, and the upper surface of the base part is placed in contact with a third surface of a side die. Thus, a clamp member, which was conventionally necessary to press a port core against a lower die, becomes unnecessary; a slight movement of the casting core is restricted; and a reduction in the positioning accuracy of the casting core is suppressed.

BRIEF DESCRIPTION OF THE DRAWINGS

Referring now to the drawings, a cylinder head casting device and a cylinder head casting method are illustrated.

DETAILED DESCRIPTION OF THE EMBODIMENTS

One embodiment of the present invention will be described below, based on the drawings. The cylinder head casting device 1 according to the present embodiment is a device for molding a cylinder head CH by injecting molten metal L of aluminum alloy, or the like, into a casting mold 30 to solidify the molten metal L. In the description below, first an internal combustion engine EG having a cylinder head CH molded by the cylinder head casting device 1 will be described, after which the cylinder head casting device 1 will be described in detail.

Figure 8A:
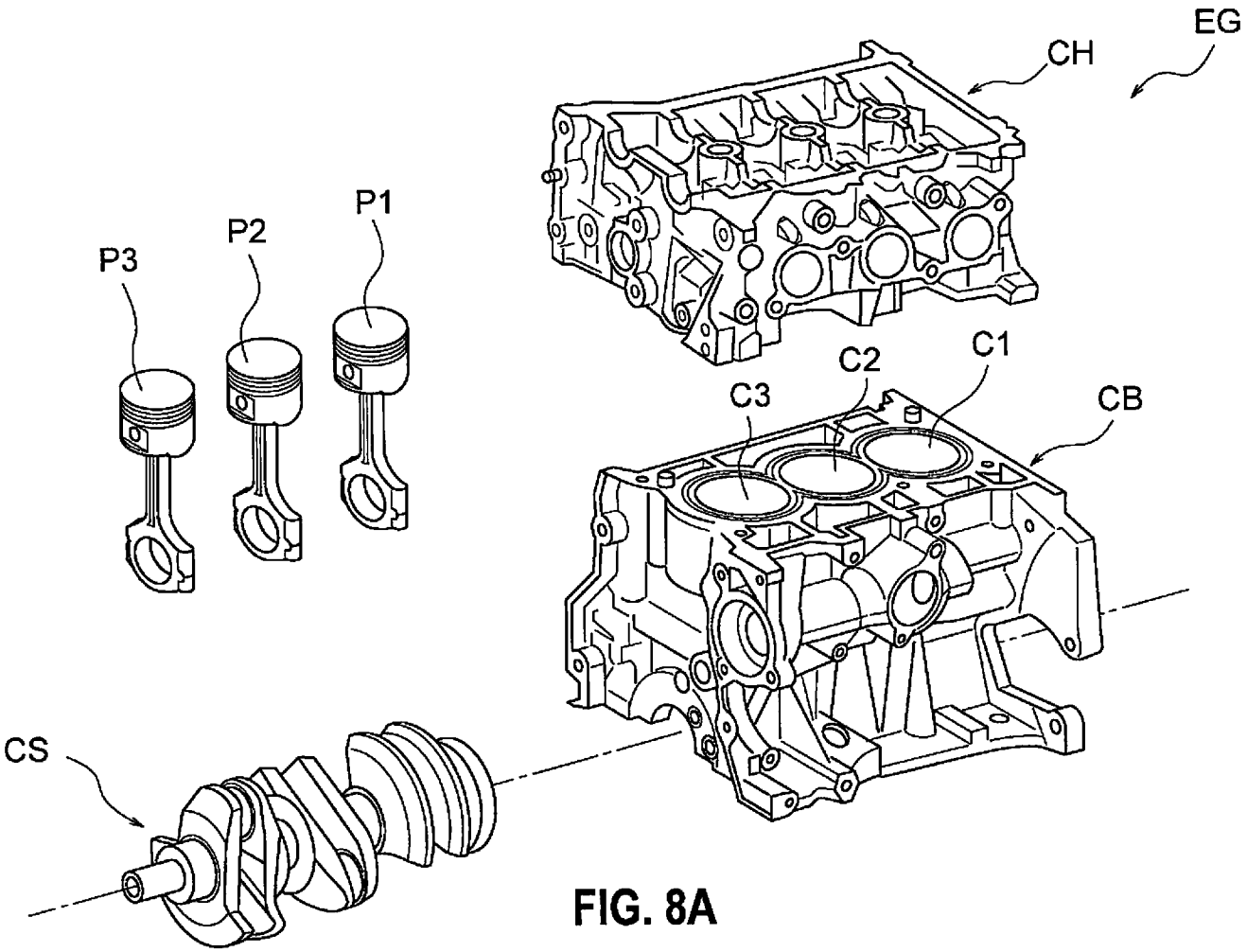
FIG. 8A is an exploded perspective view illustrating an internal combustion engine having a cylinder head molded by the device for casting a cylinder head according to the present invention.
Figure 8B:
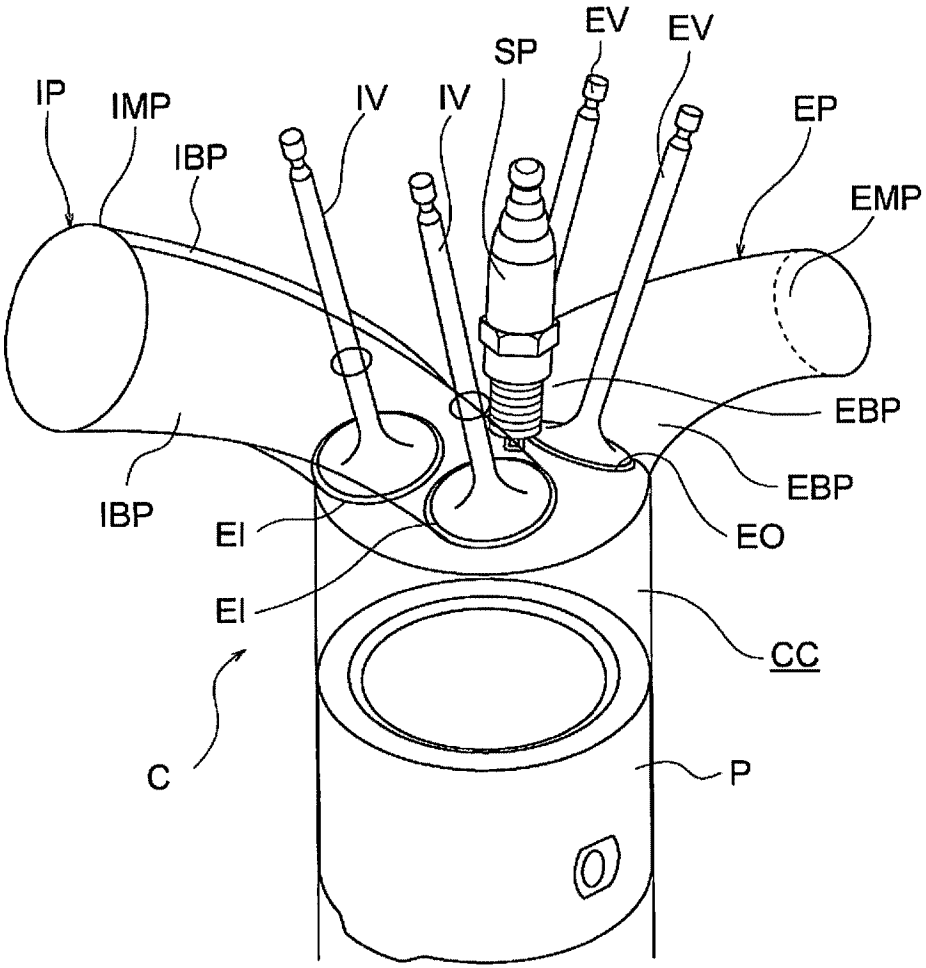
FIG. 8B is a transparent perspective view illustrating a cylinder of an internal combustion engine having a cylinder head molded by the device for casting a cylinder head according to the present invention.
Figure 8C:
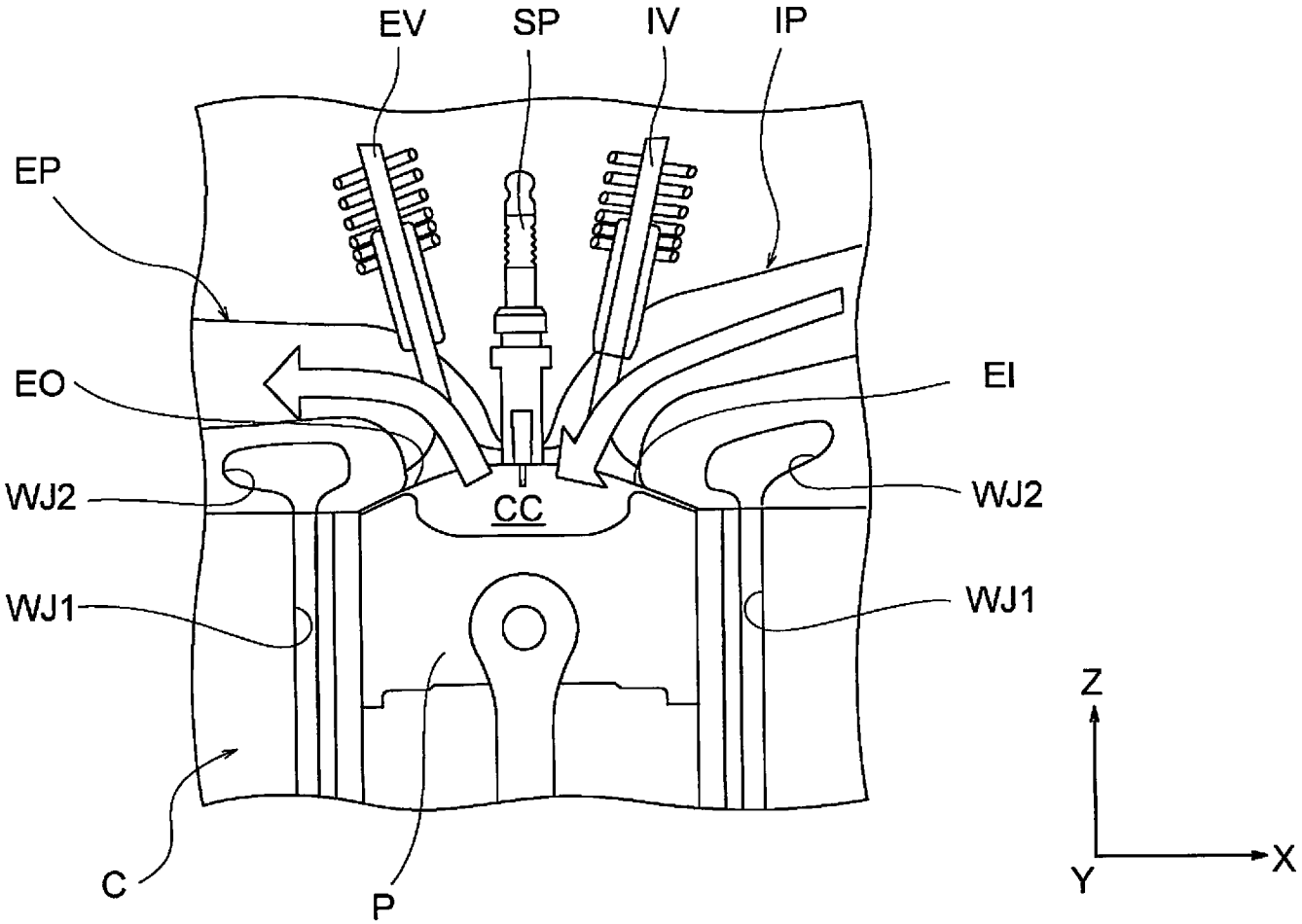
FIG. 8C is a cross-sectional view in the transverse direction illustrating a cylinder of an internal combustion engine having a cylinder head molded by the device for casting a cylinder head according to the present invention.

FIG. 8A is an exploded perspective view illustrating an internal combustion engine having a cylinder head molded by the device for casting a cylinder head according to the present invention. FIG. 8B is a transparent perspective view illustrating a cylinder of an internal combustion engine having a cylinder head molded by the device for casting a cylinder head according to the present invention. FIG. 8C is a cross-sectional view in the transverse direction illustrating a cylinder of an internal combustion engine having a cylinder head molded by the device for casting a cylinder head according to the present invention The internal combustion engine EG of the present embodiment is a DOHC (Double Over Head Camshaft) type in-line three-cylinder internal combustion engine, as illustrated in FIGS. 8A-8C. While the internal combustion engine EG of the present embodiment is an in-line three-cylinder type, no limitation is imposed thereby, and may be an in-line four-cylinder type or an in-line six-cylinder type. Alternatively, the internal combustion engine may be a V-6 cylinder type or a V-8 cylinder type. In addition, the internal combustion engine EG is an internal combustion engine employing the DOHC format, but may be an internal combustion engine that employs the SOHC (Single Over Head Camshaft) format.

The internal combustion engine EG comprises a cylinder head CH, a cylinder block CB, three cylinders C1, C2, C3 arranged substantially equidistantly, three pistons P1, P2, P3 that correspond to the cylinders C1, C2, C3, and a crankshaft CS, as illustrated in FIG. 8A. The "internal combustion engine EG" in the present embodiment corresponds to one example of the "internal combustion engine" in the present invention, the "cylinder head CH" in the present embodiment corresponds to one example of the "cylinder head" in the present invention, the "cylinders C1, C2, C3" in the present embodiment corresponds to one example of the "cylinder" in the present invention, and the "crankshaft CS" in the present embodiment corresponds to one example of the "crankshaft" in the present invention.

The cylinder head CH is mounted on the upper portion of the cylinder block CB, and fixed to the cylinder block CB by bolts (not shown), or the like. After the three pistons P1, P2, P3 are assembled via a connecting rod, the crankshaft CS is fixed to the lower portion of the cylinder block CB using a bearing cap, or the like. The three pistons P1, P2, P3 are respectively inserted in the cylinders C1, C2, C3, and are reciprocated up and down inside the cylinders C1, C2, C3 in accordance with the rotational drive of the crankshaft CS. In the description below, the cylinders C1, C2, C3 are collectively called cylinders C, and the pistons P1, P2, P3 are collectively called pistons P, when necessary.

The three cylinders C are juxtaposed along the axial direction of the crankshaft CS (that is, the juxtaposed direction of the plurality of cylinders substantially match the axial direction of the crankshaft CS). Each of the cylinders C comprises an intake port IP and an exhaust port EP that are respectively connected to the cylinders C, as illustrated in FIG. 8B. The intake port IP is configured from a main pipe part IMP that has a slight bend, and two branch pipe parts IBP that branch in two directions from the main pipe part IMP. One end of each branch pipe part IBP becomes intake holes EI, EI that link the intake port IP with the combustion chamber CC. Two intake valves IV, IV are provided to the cylinder head CH, corresponding to these intake holes EI, EI. On the other hand, the exhaust port EP is configured from a main pipe part EMP that has a slight bend, and two branch pipe parts EBP that branch in two directions from the main pipe part IMP, in the same manner as the intake port IP. One end of each branch pipe part EBP becomes exhaust holes EO, EO that link the exhaust port EP with the combustion chamber CC. Two exhaust valves EV, EV are provided to the cylinder head CH, corresponding to these exhaust holes EO, EO. Therefore, the internal combustion engine EG of the present embodiment is a 12-valve type internal combustion engine comprising two intake valves IV, IV and two exhaust valves EV, EV for each of the cylinders C1, C2, C3.

The other end of the intake port IP is linked to an intake path (not shown) via an intake manifold (not shown). In general, while not specifically shown, the intake path is provided with an air filter that purifies and feeds intake air into the combustion chamber CC, an air flow meter that detects the intake air flow rate, a throttle valve that controls the intake air flow rate, a collector, and the like. In addition, the intake port IP is provided with a fuel injection valve such that the valve tip faces the inside of the intake port. The fuel injection valve is driven to open in accordance with a command from an external circuit and injects fuel that is pressure-fed from a fuel pump and controlled to a predetermined pressure by a pressure regulator into the intake port IP. That is, intake air-fuel mixture obtained by mixing intake air drawn in from the outside and fuel injected from the fuel injection valve is sent from the intake port IP to the combustion chamber CC. The internal combustion engine may be a direct injection type in which the fuel injection valve faces the combustion chamber CC and directly injects fuel into the combustion chamber CC. The "intake port IP" in the present embodiment corresponds to one example of the "port" in the present invention.

In the cylinder C, a space surrounded by a cylinder inner wall, a crown surface of the piston P that reciprocates inside of the cylinder, and the cylinder head CH to which the intake valves IV, IV and the exhaust valves EV, EV are provided configures the combustion chamber CC. A spark plug SP is mounted facing each combustion chamber CC of each cylinder C, and ignites the intake air-fuel mixture based on an ignition signal from the external circuit.

The combustion chamber CC of the internal combustion engine EG of the present embodiment is a pent roof type combustion chamber, in which the top portion of the combustion chamber CC has a triangular roof shape. On one slope of the roof shape formed at the top portion of the combustion chamber CC are juxtaposed the two intake holes EI, EI described above, along the axial direction of the crankshaft. In contrast, on the other slope of the roof shape formed at the top portion of the combustion chamber CC are juxtaposed the two exhaust holes EO, EO described above, along the axial direction of the crankshaft. The combustion chamber CC is not limited to a pent roof type combustion chamber and may be a multi-spherical combustion chamber, or the like. The "combustion chamber CC" in the present embodiment corresponds to one example of the "combustion chamber" in the present invention.

The other end of the exhaust port EP is linked to an exhaust path (not shown) via an exhaust manifold (not shown). In general, while not specifically shown, the exhaust path is provided with an air-fuel ratio sensor that detects a particular component in the exhaust gas, an exhaust purification catalyst for purifying the exhaust gas, and the like. A detector that detects a particular component, for example, the oxygen concentration, in the exhaust gas, is used as the air-fuel ratio sensor, and the air-fuel ratio of the exhaust gas, and, by extension, of the intake air-fuel mixture, is detected by this air-fuel ratio sensor. Examples of exhaust purification catalysts that can be used include a three-way catalyst that oxidizes carbon monoxide CO and hydrocarbons HC in the exhaust gas in the vicinity of stoichiometry (theoretical air/fuel ratio $\lambda=1$, air weight/fuel weight=14.7) and that can purify the exhaust gas by carrying out a reduction of nitrogen oxides $NO_x$, or an oxidation catalyst that oxidizes carbon monoxide CO and hydrocarbons HC in the exhaust gas. The "exhaust port EP" in the present embodiment corresponds to one example of the "port" in the present invention.

The cylinders C of the internal combustion engine EG are provided with water jackets WJ1, WJ2 corresponding to each of the cylinders C, as illustrated in FIG. 8C. In the cylinder block CB, the water jacket WJ1 is provided so as to surround the outer circumference along the axial direction of the cylinders C1-C3. In the cylinder head CH, the water jacket WJ2 is provided so as to surround the outer circumference of each of the intake ports IP, IP and the exhaust ports EP, EP. This water jacket WJ2 communicates with the water jacket WJ1 that is provided to the cylinder block CB at the lower portion thereof.

Next, the cylinder head casting device 1 according to the present embodiment will be described in detail, with reference to FIG. 1, FIG. 2, FIG. 3A and FIG. 3B.

Figure 1:
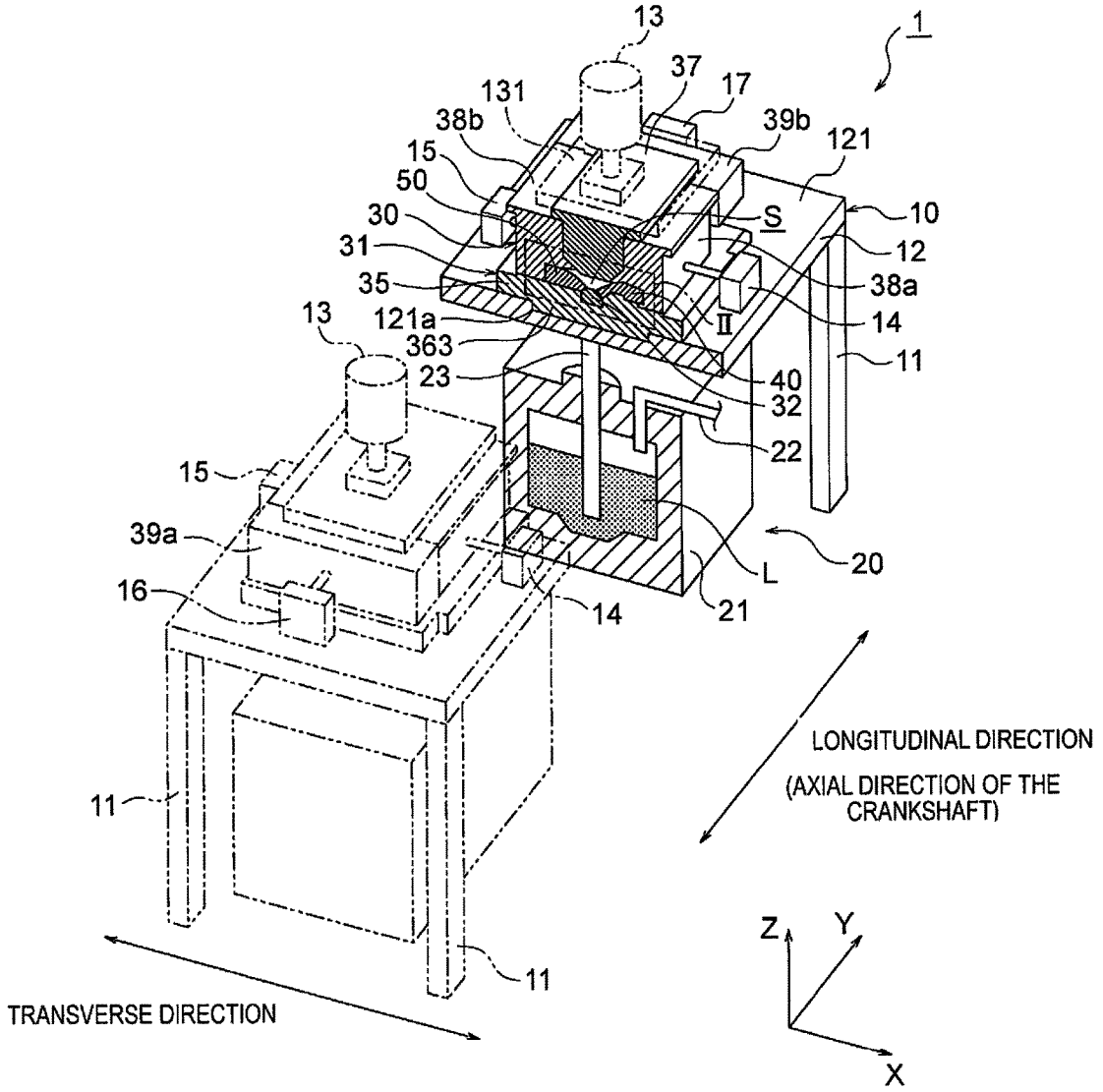
FIG. 1 is a perspective cross-sectional view illustrating one embodiment of a cylinder head casting device for casting a cylinder head according to the present invention.
Figure 2:
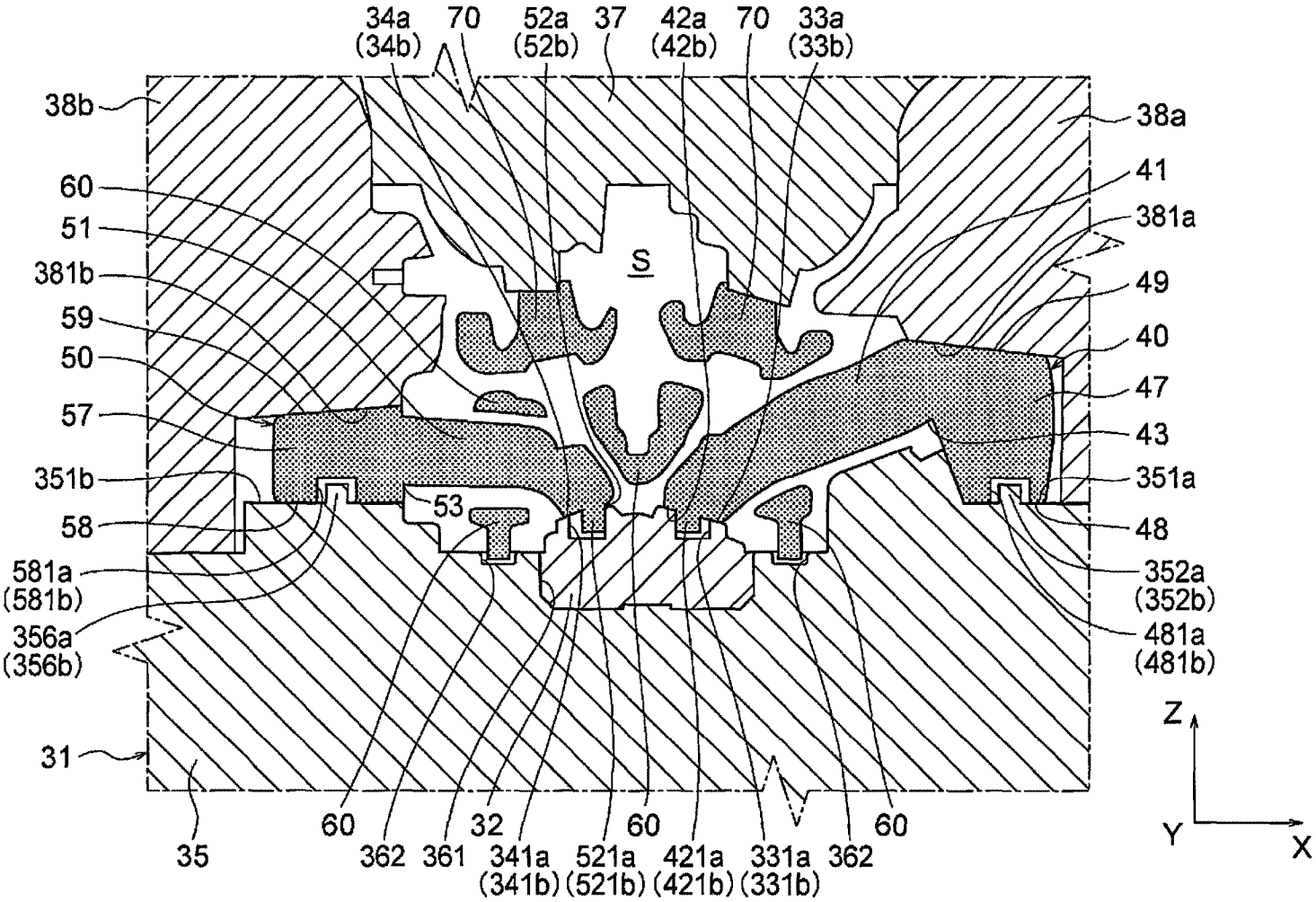
FIG. 2 is a partially enlarged view of portion II of the cylinder head casting device in FIG. 1.
Figure 3A:
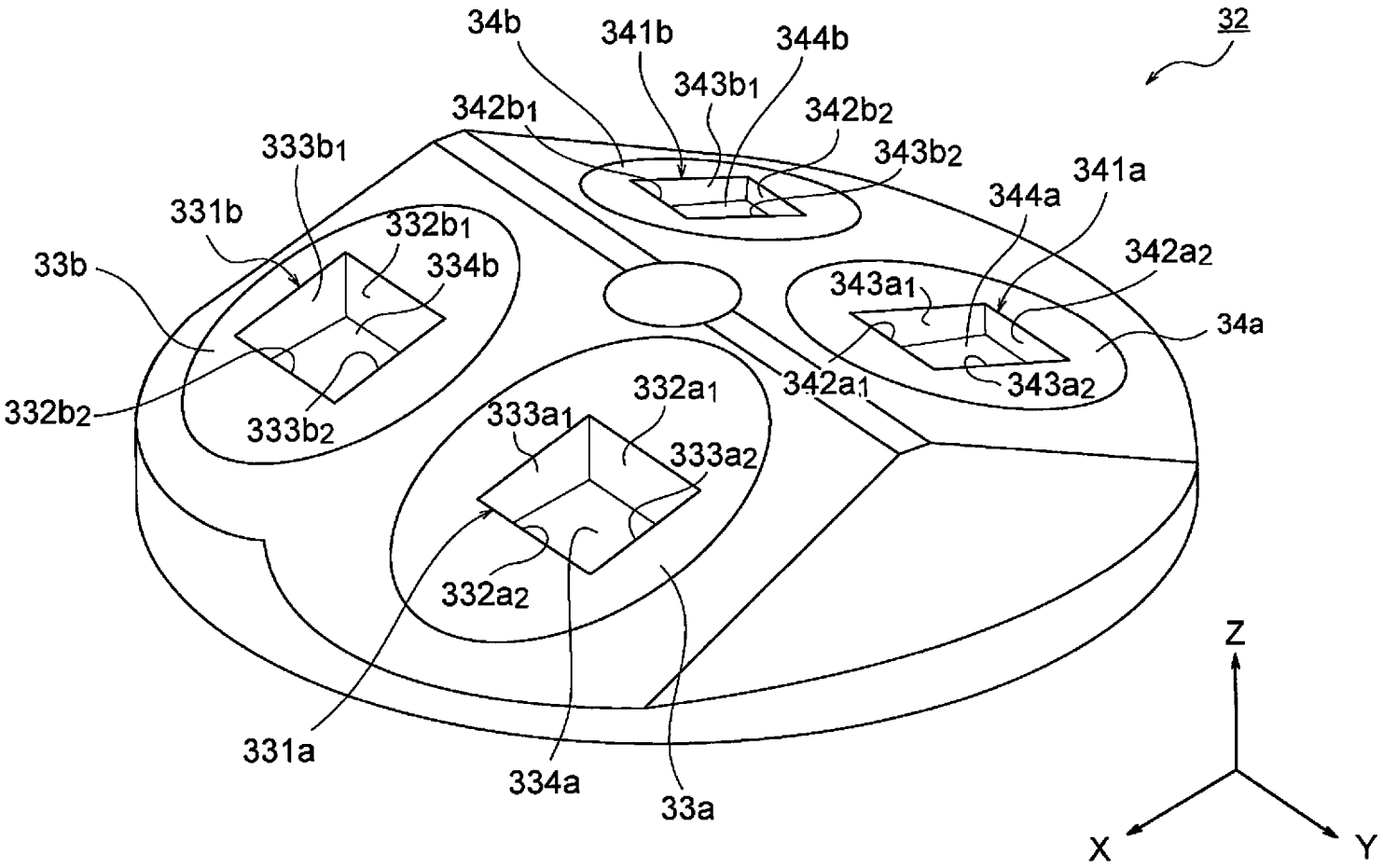
FIG. 3A is a perspective view of a chamber insert according to the present invention as seen obliquely from above.
Figure 3B:
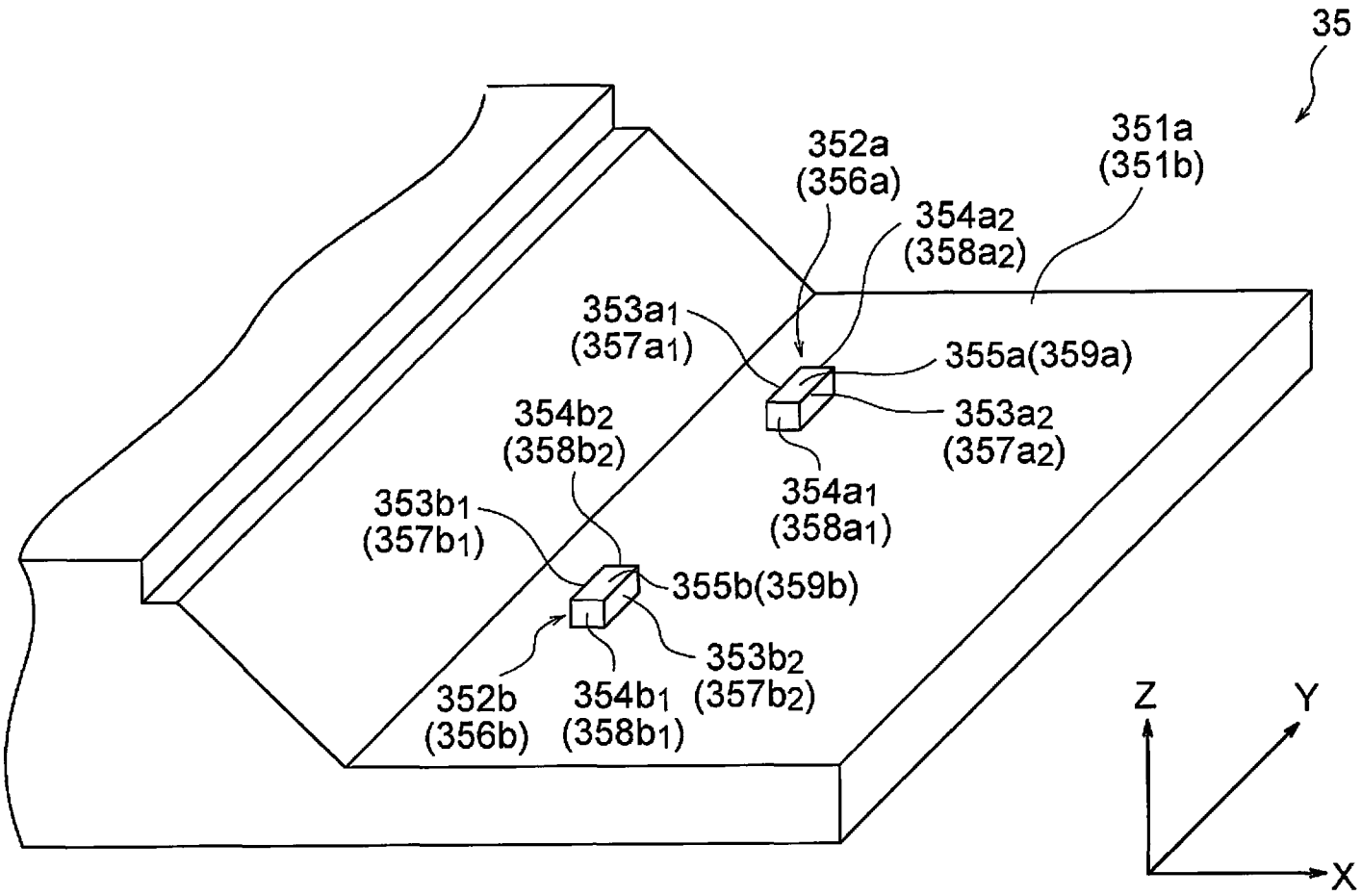
FIG. 3B is a perspective view of an air intake port core support surface of a mother die according to the present invention as seen obliquely from above.

FIG. 1 is a perspective cross-sectional view illustrating one embodiment of the device for casting a cylinder head according to the present invention; FIG. 2 is a partially enlarged view of portion II in FIG. 1, FIG. 3A is a perspective view illustrating a state in which a chamber insert according to the present invention is viewed obliquely from above; and FIG. 3B is a perspective view of an air intake port core support surface of a mother die according to the present invention as seen obliquely from above.

The cylinder head casting device 1 according to the present embodiment is a device for molding the cylinder head CH using a low-pressure casting method. In the low-pressure casting method, a casting mold is disposed above a holding furnace that holds molten metal, and the molten metal in the holding furnace is pushed up by pressurizing with air, inert gas, or the like, to inject the molten metal into the casting mold. While the low-pressure casting method is used in the cylinder head casting device 1 according to the present embodiment, there is no limitation thereto, and a gravity casting method in which molten metal is injected into the casting mold by gravity may be used. The "cylinder head casting device 1" in the present embodiment corresponds to one example of the "device for casting a cylinder head" in the present invention.

The cylinder head casting device 1 comprises a pedestal 10, a hot water supply unit 20, a casting mold 30 and a plurality of cores 40, 50, 60 and 70, as illustrated in FIG. 1. The pedestal 10 is configured from four leg portions 11, a platen 12 and a plurality of pressing devices 13-17.

The platen 12 is supported by the four leg portions 11, and the pressing devices 13-17 and the casting mold 30 are placed on the upper portion of the platen 12. A groove 121*a* is formed on the upper surface 121 of the platen 12 such that the lower die 31 (described below) of the casting mold 30 can be fixed and positioned thereto. The pressing devices 13-17 are devices having a mechanism that utilizes the pressure of compressed air, springs, screws, or the like. While details are described below, in brief, the pressing device 13 is provided corresponding to the upper die 37 of the casting mold 30; the pressing device 14 is provided corresponding to the right die 38*a* of the casting mold 30; the pressing device 15 is provided corresponding to the left die 38*b* of the casting mold 30; the pressing device 16 is provided corresponding to the front die 39*a* of the casting mold 30; and the pressing device 17 is provided corresponding to the rear die 39*b*.

The hot water supply unit 20 comprises a holding furnace 21, a compressed gas supply pipe 22 and a hot water supply pipe 23. The holding furnace 21 is disposed below the platen 12. The inside of the holding furnace 21 has a sealed structure, and molten metal L composed of aluminum alloy or the like is stored inside the holding furnace 21. The inside of the holding furnace 21 is not completely filled with the molten metal L, but a space is left in a portion thereof. This holding furnace 21 is surrounded by a heater (not shown), or the like, and the holding furnace 21 is kept warm and heated by the heater, such that the flowability of the molten metal L housed inside the holding furnace 21 is maintained.

A compressed gas supply pipe 22 is connected to the holding furnace 21. One end portion of the compressed gas supply pipe 22 faces the space inside the holding furnace 21, and the other end portion is connected to a compressed gas supply device (not shown). The compressed gas that is supplied from the compressed gas supply device is discharged into the holding furnace 21 via the compressed gas supply pipe 22. The liquid surface of the molten metal L is pressurized inside the holding furnace 21 by the supplied compressed gas.

One end portion of the hot water supply pipe 23 is immersed in the molten metal L that is housed in the holding furnace 21, and the other end portion penetrates the platen 12 and is connected to the lower die 31, which configures the casting mold 30. This hot water supply pipe 23 communicates with, for example, a cavity S (described below) defined inside the casting mold 30 via a hot water distributing pipe (not shown) that is formed in the lower die 31. When the compressed gas that is supplied by the above-described compressed gas supply device pressurizes the liquid surface of the molten metal L housed in the holding furnace 21, the molten metal L rises inside the hot water supply pipe 23 in the direction opposite gravity, and the molten metal L is poured into the cavity S that communicates with the hot water supply pipe 23. While not specifically shown, this hot water supply pipe 23 has a flared shape that gradually widens toward the side that is connected to the lower die 31, at the end portion of the side that is connected to the lower die 31.

The casting mold 30 comprises a lower die 31, an upper die 37, left and right dies 38*a*, 38*b*, and front and rear dies 39*a*, 39*b*, as illustrated in FIG. 1 and FIG. 2. The lower die 31 is configured from a chamber insert 32 and a mother die 35. The chamber insert 32 is disposed corresponding to the cylinders C described above, and the lower die 31 of the present embodiment has three chamber inserts 32. This chamber insert 32 is inserted in a fitting groove 361 formed in the mother die 35 and fixed to the mother die 35. With respect to the chamber insert 32, the outer shape of the portion facing the cavity S corresponds to the top portion of the combustion chamber CC of the internal combustion engine EG. That is, this chamber insert 32 is provided with intake hole formation surfaces 33*a*, 33*b*, for forming the intake holes EI, EI of the intake port IP of the internal combustion engine EG, and exhaust hole formation surfaces 34*a*, 34*b* for forming exhaust holes EO, EO of the exhaust port EP of the internal combustion engine EG, as illustrated in FIG. 3A.

The "lower die 31" of the present embodiment corresponds to one example of the "lower die" in the present invention; the "chamber insert 32" of the present embodiment corresponds to one example of the "insert" in the present invention; the "upper die 37" of the present embodiment corresponds to one example of the "upper die" in the present invention; the "left and right dies 38*a*, 38*b*" of the present embodiment correspond to one example of the "side die" in the present invention; and the "intake hole formation surfaces 33*a*, 33*b*" and the "exhaust hole formation surfaces

34*a*, 34*b*" of the present embodiment correspond to the "first surface" in the present invention.

The intake hole formation surfaces 33*a*, 33*b* are formed so as to correspond to one inclined surface of the top portion (that is, the top portion of the triangular roof shape) of the combustion chamber CC, which is a pent roof type combustion chamber, and are inclined so as to approach the mother die 35 as the distance from the exhaust hole formation surfaces 34*a*, 34*b* increases, as illustrated in FIG. 3A. To each of the intake hole formation surfaces 33*a*, 33*b* is formed a pair of first intake side recesses 331*a*, 331*b* that are depressed toward the mother die 35 side. While details will be described below, in brief, the "first intake side recesses 331*a*, 331*b*" that correspond to the first body part 41 of the present embodiment correspond to one example of the "first engagement portion" in the present invention, and the "first intake side recesses 331*a*, 331*b*" that correspond to the second body part 44 correspond to one example of the "fifth engagement portion" in the present invention.

The first intake side recess 331*a* comprises four inner side surfaces 332$a_1$, 332$a_2$, 333$a_1$, 333$a_2$ and a bottom surface 334*a*. The first intake side recess 331*b* comprises four inner side surfaces 332$b_1$, 332$b_2$, 333$b_1$, 333$b_2$, and a bottom surface 334*b*. The inner side surfaces 332$a_1$, 332$a_2$, 332$b_1$, 332$b_2$ are side surfaces that are substantially parallel to the Y direction (that is, substantially parallel to the axial direction of the crankshaft CS of the internal combustion engine EG). On the other hand, the inner side surfaces 333$a_1$, 333$a_2$, 333$b_1$, 333$b_2$ are side surfaces that are substantially parallel to the X direction (that is, substantially perpendicular to the axial direction of the crankshaft CS). The bottom surfaces 334*a*, 334*b* are surfaces that are perpendicular to the Z direction facing upward (that is, the axial direction of the cylinders C).

In the first intake side recess 331*a*, the inner side surfaces 332$a_1$, 332$a_2$ are opposed, and the inner side surfaces 333$a_1$, 333$a_2$ are opposed; a rectangular recess that is opened above is formed by these inner side surfaces 332$a_1$, 332$a_2$, 333$a_1$, 333$a_2$ being continuous with the bottom surface 334*a*. Similarly, in the first intake side recess 331*b*, the inner side surfaces 332$b_1$, 332$b_2$ are opposed, and the inner side surfaces 333$b_1$, 333$b_2$ are opposed; a rectangular recess that is opened above is formed by these inner side surfaces 332$b_1$, 332$b_2$, 333$b_1$, 333$b_2$ being continuous with the bottom surface 334*b*.

The exhaust hole formation surfaces 34*a*, 34*b* are formed so as to correspond to the other inclined surface of the top portion (that is, the top portion of the triangular roof shape) of the combustion chamber CC, which is a pent roof type combustion chamber, and are inclined so as to approach the mother die 35 as the distance from the intake hole formation surfaces 33*a*, 33*b* increases. To each of the exhaust hole formation surfaces 34*a*, 34*b* is formed a pair of exhaust side first recesses 341*a*, 341*b* that are depressed toward the mother die 35 side. While details will be described below, in brief, the "exhaust side first recesses 341*a*, 341*b*" that correspond to the first body part 51 of the present embodiment correspond to one example of the "first engagement portion" in the present invention, and the "exhaust side first recesses 341*a*, 341*b*" that correspond to the second body part 54 correspond to one example of the "fifth engagement portion" in the present invention.

The exhaust side first recess 341*a* comprises four inner side surfaces 342$a_1$, 342$a_2$, 343$a_1$, 343$a_2$ and a bottom surface 344*a*. The exhaust side first recess 341*b* comprises four inner side surfaces 342$b_1$, 342$b_2$, 343$b_1$, 343$b_2$, and a bottom surface 344*b*. The inner side surfaces 342$a_1$, 342$a_2$, 342$b_1$, 342$b_2$ are side surfaces that are substantially parallel to the Y direction. On the other hand, the inner side surfaces 343$a_1$, 343$a_2$, 343$b_1$, 343$b_2$ are side surfaces that are substantially parallel to the X direction. The bottom surfaces 344*a*, 344*b* are surfaces that are perpendicular to the Z direction facing upward.

In the exhaust side first recess 341*a*, the inner side surfaces 342$a_1$, 342$a_2$ are opposed, and the inner side surfaces 343$a_1$, 343$a_2$ are opposed; a rectangular recess that is opened above is formed by these inner side surfaces 342$a_1$, 342$a_2$, 343$a_1$, 343$a_2$ being continuous with the bottom surface 344*a*. Similarly, in the exhaust side first recess 341*b*, the inner side surfaces 342$b_1$, 342$b_2$ are opposed and the inner side surfaces 343$b_1$, 343$b_2$ are opposed; a rectangular recess that is opened above is formed by these inner side surfaces 342$b_1$, 342$b_2$, 343$b_1$, 343$b_2$ being continuous with the bottom surface 344*b*.

Returning to FIG. 1 and FIG. 2, the mother die 35 is fixed to the platen 12. To the portion of the upper surface of the mother die 35 that faces the cavity S are formed a fitting groove 361 to which the chamber insert 32 can be fitted and a jacket core support groove 362 to which a jacket core 60 can be attached. In addition, the lower surface of the mother die 35 is provided with a projection 363 that is fitted to the groove 121*a* of the platen 12.

An intake port core support surface 351*a* that contacts a base part 47 (described below) of the intake port core 40, and an exhaust port core support surface 351*b* that contacts a base part 57 (described below) of the exhaust port core 50 are formed to the mother die 35. The left and right dies 38*a*, 38*b* and the front and rear dies 39*a*, 39*b* can be placed within a range of the upper surface of the mother die 35 that does not interfere with the portion that faces the cavity S and the port core support surfaces 351*a*, 351*b*. The respective movement directions of the left and right dies 38*a*, 38*b* and the front and rear dies 39*a*, 39*b* are fixed (for example, the left and right dies 38*a*, 38*b* are reciprocated only in a direction along the X direction, and the front and rear dies 39*a*, 39*b* are reciprocated only in a direction along the Y direction), and, for example, rails may be disposed on the upper surface of the mother die 35, and the left and right dies 38*a*, 38*b* and the front and rear dies 39*a*, 39*b* may be placed via the rails in order to regulate the movement directions thereof.

The port core support surfaces 351*a*, 351*b* are formed as substantially horizontal flat surfaces and extend along a direction that is substantially parallel to the Y direction. A pair of second intake side protrusions 352*a*, 352*b* that protrude toward the +Z direction are formed on the intake port core support surface 351*a*, as illustrated in FIG. 3B.

The second intake side protrusion 352*a* comprises four outer side surfaces 353$a_1$, 353$a_2$, 354$a_1$, 354$a_2$ and a top surface 355*a*. The second intake side protrusion 352*b* comprises four outer side surfaces 353$b_1$, 353$b_2$, 354$b_1$, 354$b_2$, and a top surface 355*b*. The outer side surfaces 353$a_1$, 353$a_2$, 353$b_1$, 353$b_2$ are side surfaces that are substantially parallel to the Y direction. On the other hand, the outer side surfaces 354$a_1$, 354$a_2$, 354$b_1$, 354$b_2$ are side surfaces that are substantially parallel to the X direction. The top surfaces 355*a*, 355*b* are surfaces that are perpendicular to the Z direction facing upward.

In the second intake side protrusion 352*a*, the outer side surfaces 353$a_1$, 353$a_2$ are opposed and the outer side surfaces 354$a_1$, 354$a_2$ are opposed; a rectangular protrusion that protrudes upwards is formed by these outer side surfaces 353$a_1$, 353$a_2$, 354$a_1$, 354$a_2$ being continuous with the top surface 355*a*. Similarly, in the second intake side protrusion 352*b*, the outer side surfaces 353$b_1$, 353$b_2$ are opposed, and the outer side surfaces 354$b_1$, 354$b_2$ are opposed; a rectangular protrusion that protrudes upwards is formed by these outer side surfaces 353$b_1$, 353$b_2$, 354$b_1$, 354$b_2$ being continuous with the top surface 355*b*.

A pair of exhaust-side second protrusions 356*a*, 356*b* that protrude toward the +Z direction are formed on the exhaust port core support surface 351*b*, in the same manner as the intake port core support surface 351*a*. These exhaust-side second protrusions 356*a*, 356*b* are juxtaposed along the axial direction of the crankshaft CS. While exhibiting some difference in shape from the intake port core support surface 351*a*, the exhaust port core support surface 351*b* of the present embodiment has basically the same structure that is mirror-symmetrical with the intake port core support surface 351*a*; therefore, the intake port core support surface 351*a* is illustrated in FIG. 3B, and a drawing of the intake port core support surface 351*b* is omitted by providing corresponding reference symbols in parentheses.

The exhaust-side second protrusion 356*a* comprises four outer side surfaces 357$a_1$, 357$a_2$, 358$a_1$, 358$a_2$ and a top surface 359*a*. The exhaust-side second protrusion 356*b* comprises four outer side surfaces 357$b_1$, 357$b_2$, 358$b_1$, 358$b_2$, and a top surface 359*b*. The outer side surfaces 357$a_1$, 357$a_2$, 357$b_1$, 357$b_2$ are side surfaces that are substantially parallel to the Y direction. On the other hand, the outer side surfaces 358$a_1$, 358$a_2$, 358$b_1$, 358$b_2$ are side surfaces that are substantially parallel to the X direction. The top surfaces 359*a*, 359*b* are surfaces that are perpendicular to the Z direction facing upward.

In the exhaust-side second protrusion 356*a*, the outer side surfaces 357$a_1$, 357$a_2$ are opposed, and the outer side surfaces 358$a_1$, 358$a_2$ are opposed; a rectangular protrusion that protrudes upward is formed by these outer side surfaces 357$a_1$, 357$a_2$, 358$a_1$, 358$a_2$ being continuous with the top surface 359*a*. Similarly, in the exhaust-side second protrusion 356*b*, the outer side surfaces 357$b_1$, 357$b_2$ are opposed, and the outer side surfaces 358$b_1$, 358$b_2$ are opposed; a rectangular protrusion that protrudes upwards is formed by these outer side surfaces 357$b_1$, 357$b_2$, 358$b_1$, 358$b_2$ being continuous with the top surface 359*b*. The "port core support surfaces 351*a*, 351*b*" of the present embodiment correspond to one example of the "second surface" in the present invention, and the "exhaust-side second protrusions 352*a*, 352*b*" and the "exhaust-side second protrusions 356*a*, 356*b*" of the present embodiment correspond to one example of the "fourth engagement portion" in the present invention.

The upper die 37 is supported on a die base 131 that approaches or separates from the lower die 31 described above under the driving of the pressing device 13, and is disposed to oppose the lower die 31, as illustrated in FIG. 1 and FIG. 2. The left and right dies 38*a*, 38*b* are disposed opposite of each other. The right die 38*a* is connected to the pressing device 14 and the left die 38*b* is connected to the pressing device 15. The left and right dies 38*a*, 38*b* are operated to approach or separate from each other, under synchronous driving of these pressing devices 14, 15. These left and right dies 38*a*, 38*b* comprise port core pressing surfaces 381*a*, 381*b*, which are inclined so as to approach the lower die 31 as they are separated from each other. The intake port core pressing surface 381*a* opposes the above-described intake port core support surface 351*a*, and the exhaust port core pressing surface 381*b* opposes the above-described exhaust port core support surface 351*b*. In the present embodiment, this intake port core pressing surface 381*a* comes in contact with the base part 47 of the intake port core 40, and the exhaust port core pressing surface 381*b* comes in contact with the base part 57 of the exhaust port core 50. The front and rear dies 39*a*, 39*b* are disposed opposite of each other. The front die 39*a* is connected to the pressing device 16 and the rear die 39*b* is connected to the pressing device 17. The front and rear dies 39*a*, 39*b* are operated to approach or separate from each other, under synchronous driving of the pressing devices 16, 17. The "port core pressing surfaces 381*a*, 381*b*" of the present embodiment correspond to one example of the "third surface" in the present invention.

In the casting mold 30 of the present embodiment described above, a cavity S that corresponds to the outer shape of the cylinder head CH is defined inside the casting mold 30, by mold clamping being carried out by the lower die 31, upper die 37, left and right dies 38*a*, 38*b*, and front and rear dies 39*a*, 39*b*. In the present embodiment, a gasket surface of the cylinder head CH is formed on the lower die 31 side of the cavity S, and a cover surface of the cylinder head CH is formed on the upper die 37 side of the cavity S. The "cavity S" of the present embodiment corresponds to one example of the "cavity" in the present invention.

Intake/exhaust port cores 40, 50, a jacket core 60, and a top core 70, which are supported in the cavity S are disposed in the cavity defined inside the casting mold 30. The jacket core 60 has an outer shape corresponding to the water jacket WJ2 of the cylinder head CH, and is disposed along the periphery of the body parts of the port cores 40, 50. This jacket core 60 is supported in the cavity S by being attached to a jacket core support groove 362, which is formed in the lower die 31. The top core 70 is a core having an outer shape that corresponds to a space for housing a valve spring, or the like, that controls the forward and backward movements of the intake/exhaust valves IV, EV.

Figure 4:
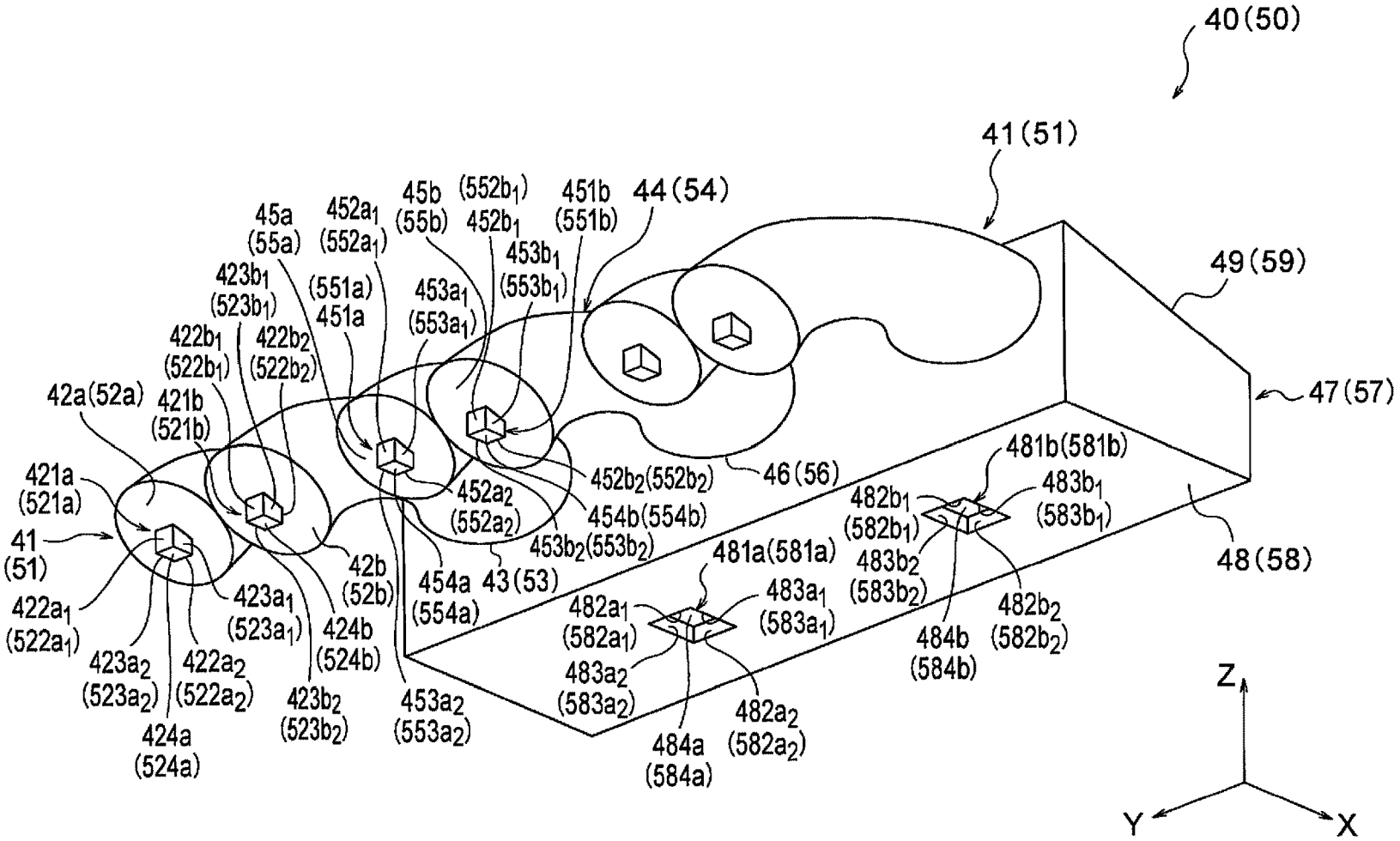
FIG. 4 is a perspective view of one embodiment of a port core according to the present invention as seen obliquely from above.

In the following description, the intake/exhaust port cores 40, 50 of the present embodiment will be described in detail, with reference to FIG. 1, FIG. 2, and FIG. 4. FIG. 4 is a perspective view illustrating a state in which one embodiment of a port core according to the present invention is viewed obliquely from below.

While exhibiting some difference in shape from the intake port core 40, the exhaust port core 50 has basically the same structure that is mirror-symmetrical with the intake port core 40. Therefore, in the following description, the intake port core 40 is illustrated in FIG. 4, and a drawing of the exhaust port core 50 is omitted by providing corresponding reference symbols in parentheses; configurations that are different between the intake port core 40 and the exhaust port core 50 will be described on a case-by-case basis. The "intake port core 40" and the "exhaust port core 50" of the present embodiment correspond to one example of the "casting core" in the present invention.

The intake port core 40 of the present embodiment is used to form the intake port IP of the internal combustion engine EG (the exhaust port core 50 is used to form the exhaust port EP of the internal combustion engine EG), and comprises two first body parts 41, one second body part 44, and a base part 47, as illustrated in FIG. 4. Each of the body parts 41, 44, 41 have an outer shape corresponding to the intake ports IP, IP, IP. That is, the intake port IP is configured from a main pipe part IMP and branch pipe parts IBP that branch in two directions from the main pipe part IMP, as described above; in contrast, the body parts 41, 44, 41 of the present embodiment have distal ends that are branched in two directions corresponding to the outer shape of the intake port IP. The distal ends of the body parts 41, 44, 41 are inclined surfaces that correspond to the intake hole formation surfaces 33*a*, 33*b*, which are inclined surfaces (that is, inclined surfaces that are inclined so as to approach the lower die 31 as the distance from the exhaust hole formation surfaces 34*a*, 34*b* increases), and can be closely engaged with the intake hole formation surfaces 33*a*, 33*b*. In the exhaust port core 50, the distal ends of the body parts 51, 54, 51 are inclined surfaces that correspond to the exhaust hole formation surfaces 34*a*, 34*b*, which are inclined surfaces (that is, inclined surfaces that are inclined so as to approach the lower die 31 as the distance from the intake hole formation surfaces 33*a*, 33*b* increases).

These body parts 41, 44, 41 are connected to the base part 47 on the proximal ends 43, 46, 43 side of the body parts 41, 44, 41, and these body parts 41, 44, 41 and the base part 47 are integrally formed. At the proximal ends 43, 46, 43 of the body parts 41, 44, 41 of the intake port core 40 is formed a connection surface with the intake manifold of the intake port IP that is formed by the intake port core 40. The intervals between the body parts 41, 44, 41 are arranged substantially equidistantly, in correspondence with the cylinders C1, C2, C3 of the internal combustion engine EG. In the intake port core 40 of the present embodiment, the body part positioned at both ends is the first body part 41, and the body part positioned in the center of the remaining body part is the second body part 44.

The first body part 41 (the body part positioned at both ends of the intake port core 40) comprises distal ends 42*a*, 42*b* and comes in contact with the intake hole formation surfaces 33*a*, 33*b* of the chamber insert 32 at the distal ends 42*a*, 42*b* (refer to FIG. 2). At the distal ends 42*a*, 42*b* of each first body part 41 are formed a pair of first intake side protrusions 421*a*, 421*b* that protrude toward the −Z direction.

The intake-side first protrusion 421*a* comprises four outer side surfaces 422$a_1$, 422$a_2$, 423$a_1$, 423$a_2$ and a top surface 424*a*. The intake-side first protrusion 421*b* comprises four outer side surfaces 422$b_1$, 422$b_2$, 423$b_1$, 423$b_2$, and a top surface 424*b*. The outer side surfaces 422$a_1$, 422$a_2$, 422$b_1$, 422$b_2$ are side surfaces that are substantially parallel to the Y direction. On the other hand, the outer side surfaces 423$a_1$, 423$a_2$, 423$b_1$, 423$b_2$ are side surfaces that are substantially parallel to the X direction. The top surfaces 424*a*, 424*b* are surfaces that are perpendicular to the Z direction facing downwards.

In the intake-side first protrusion 421*a*, the outer side surfaces 422$a_1$, 422$a_2$ are opposed, and the outer side surfaces 423$a_1$, 423$a_2$ are opposed; a rectangular protrusion that protrudes downwards is formed by these outer side surfaces 422$a_1$, 422$a_2$, 423$a_1$, 423$a_2$ being continuous with the top surface 424*a*. Similarly, in the intake-side first protrusion 421*b*, the outer side surfaces 422$b_1$, 422$b_2$ are opposed and the outer side surfaces 423$b_1$, 423$b_2$ are opposed; a rectangular protrusion that protrudes downwards is formed by these outer side surfaces 422$b_1$, 422$b_2$, 423$b_1$, 423$b_2$ being continuous with the top surface 424*b*. The "first body part 41" of the present embodiment corresponds to one example of the "first body part" in the present invention, the "distal ends 42*a*, 42*b*" of the present embodiment correspond to one example of the "distal end of the body part" in the present invention, and the "first intake side protrusions 421*a*, 421*b*" of the present embodiment correspond to one example of the "second engagement portion" in the present invention.

The second body part 44 (the body part positioned at the center of the intake port core 40) comprises distal ends 45*a*, 45*b*, and comes in contact with the intake hole formation surfaces 33*a*, 33*b* of the chamber insert 32 at the distal ends 45*a*, 45*b* (refer to FIG. 2). At the distal ends 45*a*, 45*b* of each second body part 44 are formed first intake side protrusions 451*a*, 451*b*, in the same manner as the first intake side protrusions 421*a*, 421*b* that are formed at the distal ends 42*a*, 42*b* of the first body part 41 described above. That is, the first intake side protrusion 451*a* comprises outer side surfaces 452$a_1$, 452$a_2$, which are side surfaces that are substantially parallel to the Y direction, and outer side surfaces 453$a_1$, 453$a_2$, which are side surfaces that are substantially parallel to the X direction, and is a rectangular protrusion that protrudes downwards by these outer side surfaces 452$a_1$, 452$a_2$, 453$a_1$, 453$a_2$ being continuous with the bottom surface 454*a*. Similarly, the first intake side protrusion 451*b* comprises outer side surfaces 452$b_1$, 452$b_2$, which are side surfaces that are substantially parallel to the Y direction, and outer side surfaces 453$b_1$, 453$b_2$, which are side surfaces that are substantially parallel to the X direction, and is a rectangular protrusion that protrudes downwards by these outer side surfaces 452$b_1$, 452$b_2$, 453$b_1$, 453$b_2$ being continuous with the bottom surface 454*b*. The "second body part 44" of the present embodiment corresponds to one example of the "second body part" in the present invention; the "distal ends 45*a*, 45*b*" of the present embodiment correspond to one example of the "distal end of the body part" in the present invention; and the "first intake side protrusions 451*a*, 451*b*" of the present embodiment correspond to one example of the "sixth engagement portion" in the present invention.

While the first intake side protrusion 421*a* that is formed at the distal end 42*a* of the first body part 41 and the first intake side protrusion 451*a* that is formed at the distal end 45*a* of the second body part 44 are different in that the positions in which these first intake side protrusions 421*a*, 451*a* are fitted with the first intake side recesses 331*a*, 331*a* are different, likewise, the first intake side protrusion 421*b* that is formed at the distal end 42*b* of the first body part 41 and the first intake side protrusion 451*b* that is formed at the distal end 45*b* of the second body part 44 are different in that the positions in which these first intake side protrusions 421*b*, 451*b* are fitted with the first intake side recesses 331*b*, 331*b* are different; this will be described in detail below.

The base part 47 is held between the mother die 35 and the right die 38*a* described above. This base part 47 protrudes from a side surface of the cavity S formed inside the casting mold 30 (that is, a side surface of the molded cylinder head CH), and each of the body parts 41, 44, 41 of the intake port core 40 is supported in the cavity S by the base part 47 being supported on the lower die 31 and the right die 38*a*.

The base part 47 comes in contact with the intake port core support surface 351*a* of the mother die 35 on the lower surface 48, and comes in contact with the intake port core pressing surface 381*a* of the right die 38*a* on the upper surface 49. The upper surface 49 is an inclined surface, which is inclined so as to approach the lower die 31 as the distance from the distal end of the body part is increased in a transverse direction cross-sectional view. This lower surface 48 and the intake port core pressing surface 381*a* described above are inclined surfaces that are inclined with essentially equal gradients and are in close contact with each other. In the exhaust port core 50, the upper surface 59 is an inclined surface, which is inclined so as to approach the lower die 31 as the distance from the distal end of the body part is increased in a transverse direction cross-sectional view. The lower surface 48 is a substantially horizontal flat surface, and second intake side recesses 481*a*, 481*b* that are depressed toward the +Z direction are formed on the lower surface 48.

The intake-side second recess 481*a* comprises four inner side surfaces 482$a_1$, 482$a_2$, 483$a_1$, 483$a_2$ and a bottom surface 484*a*. The intake-side second recess 481*b* comprises four inner side surfaces 482*b*$_1$, 482*b*$_2$, 483*b*$_1$, 483*b*$_2$, and a bottom surface 484*b*. The inner side surfaces 482*a*$_1$, 482*a*$_2$, 482*b*$_1$, 482*b*$_2$ are side surfaces that are substantially parallel to the Y direction. On the other hand, the inner side surfaces 483*a*$_1$, 483*a*$_2$, 483*b*$_1$, 483*b*$_2$ are side surfaces that are substantially parallel to the X direction. The bottom surfaces 484*a*, 484*b* are surfaces that are perpendicular to the Z direction facing downward.

In the intake-side second recess 481*a*, the inner side surfaces 482*a*$_1$, 482*a*$_2$ are opposed, and the inner side surfaces 483*a*$_1$, 483*a*$_2$ are opposed; a rectangular recess that is opened below is formed by these inner side surfaces 482*a*$_1$, 482*a*$_2$, 483*a*$_1$, 483*a*$_2$ being continuous with the bottom surface 484*a*. Similarly, in the intake-side second recess 481*b*, the inner side surfaces 482*b*$_1$, 482*b*$_2$ are opposed, and the inner side surfaces 483*b*$_1$, 483*b*$_2$ are opposed; a rectangular recess that is opened below is formed by these inner side surfaces 482*b*$_1$, 482*b*$_2$, 483*b*$_1$, 483*b*$_2$ being continuous with the bottom surface 484*b*. The "base part 47" of the present embodiment corresponds to one example of the "base part" in the present invention; the "lower surface 48" of the present embodiment corresponds to one example of the "lower surface of the base part" in the present invention; the "upper surface 49" of the present embodiment corresponds to the "upper surface of the base part" in the present invention; and the "second intake side recesses 481*a*, 481*b*" of the present embodiment correspond to one example of the "third engagement portion" in the present invention.

Next, the action of the cylinder head casting device 1 according to the present embodiment will be described in detail with reference to FIG. 5 and FIGS. 6A-6D.

Figure 5:
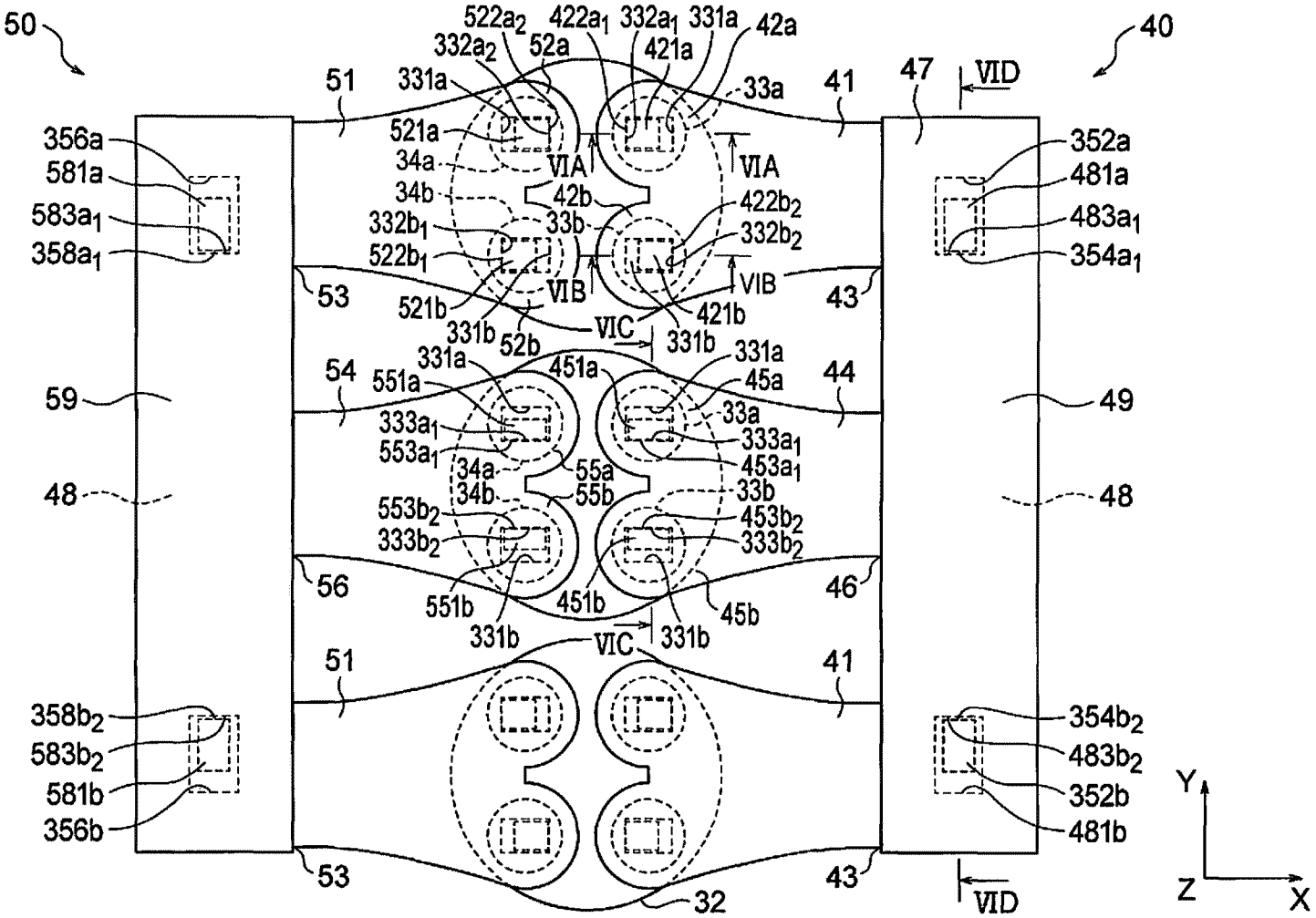
FIG. 5 is a plan view illustrating a state in which the port core is supported on a lower die according to the present invention.
Figure 6A:
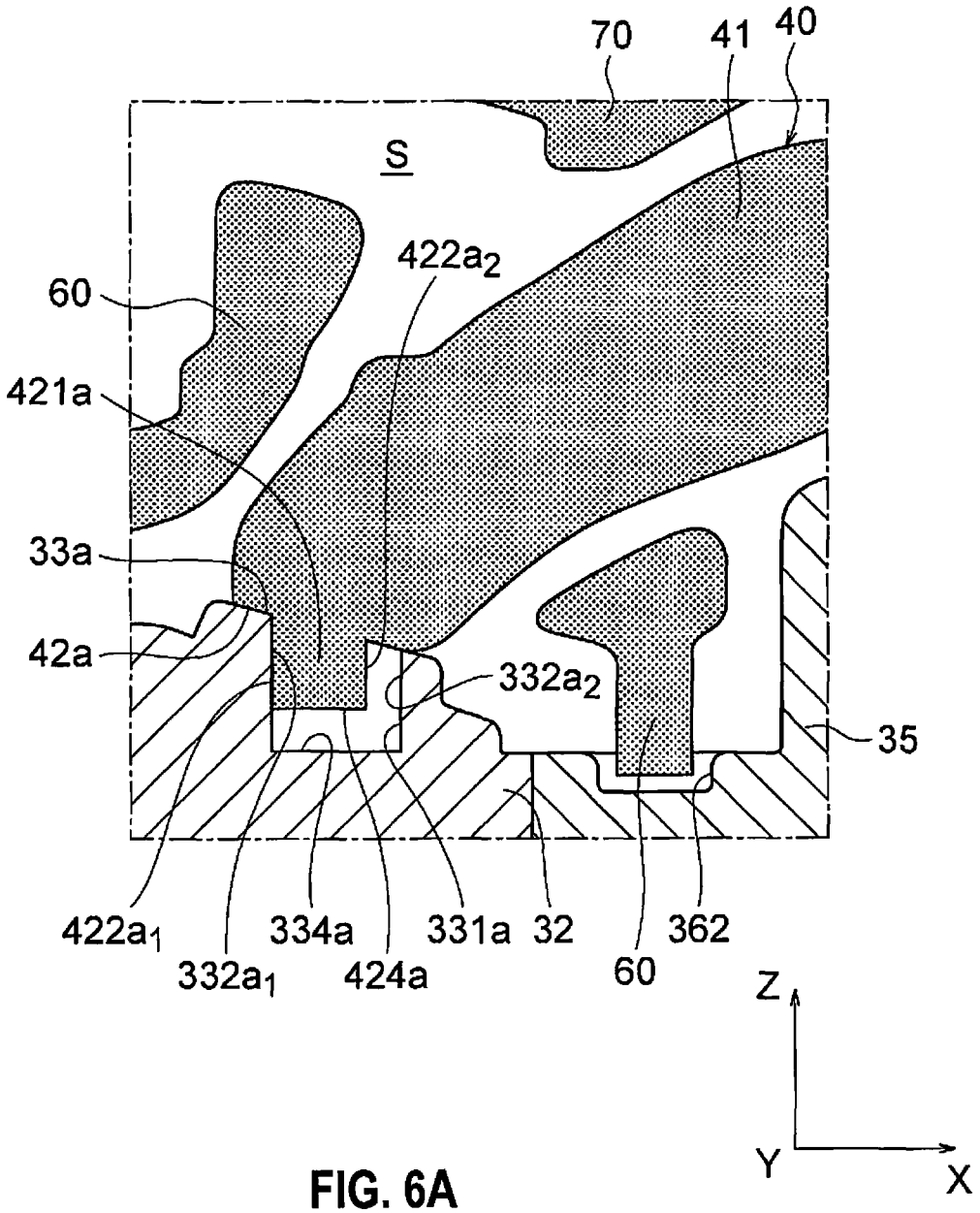
FIG. 6A is a cross-sectional view of the the port core as seen along line VIA-VIA of FIG. 5.
Figure 6B:
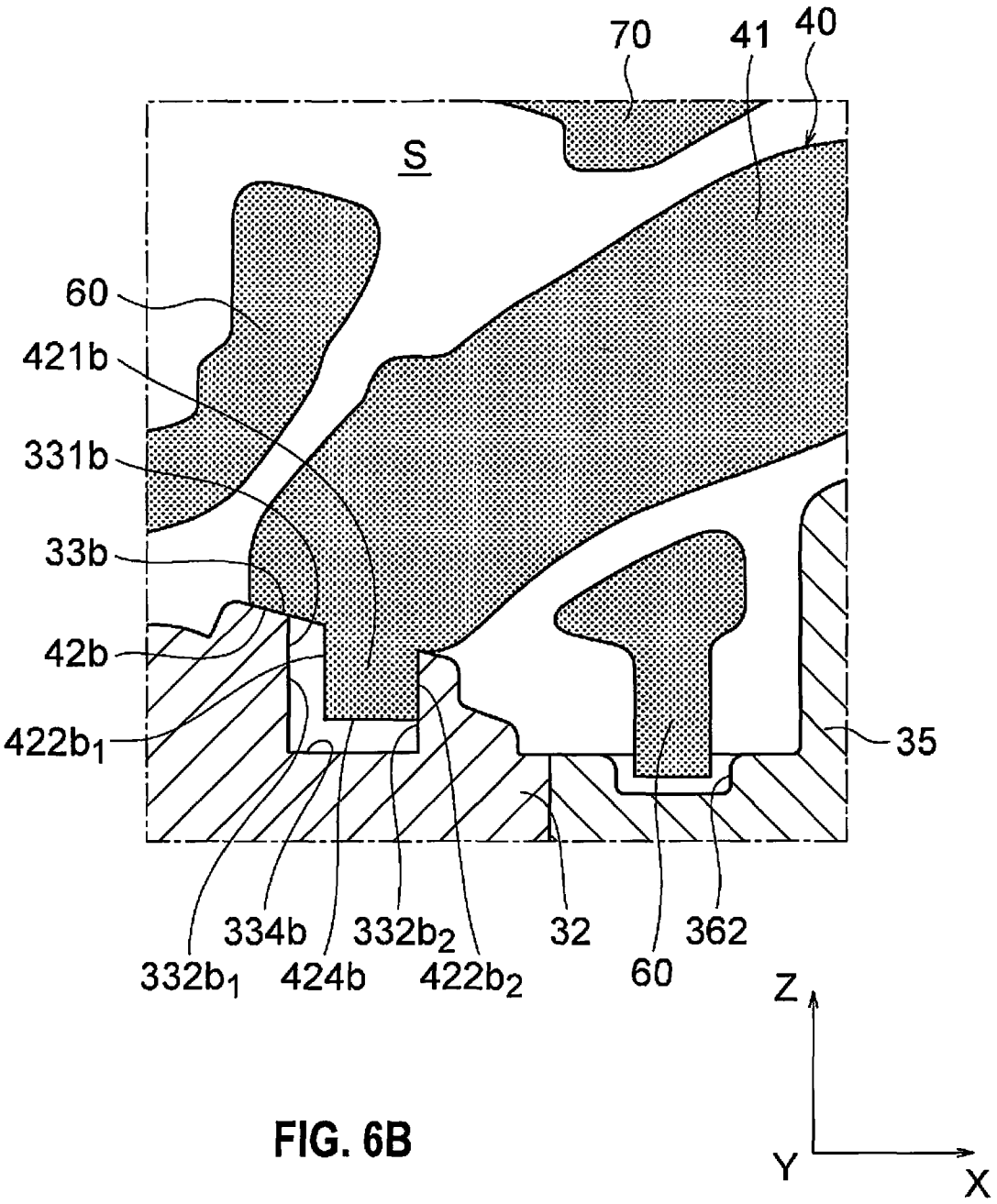
FIG. 6B is a cross-sectional view of the the port core as seen along line VIB-VIB of FIG. 5.
Figure 6C:
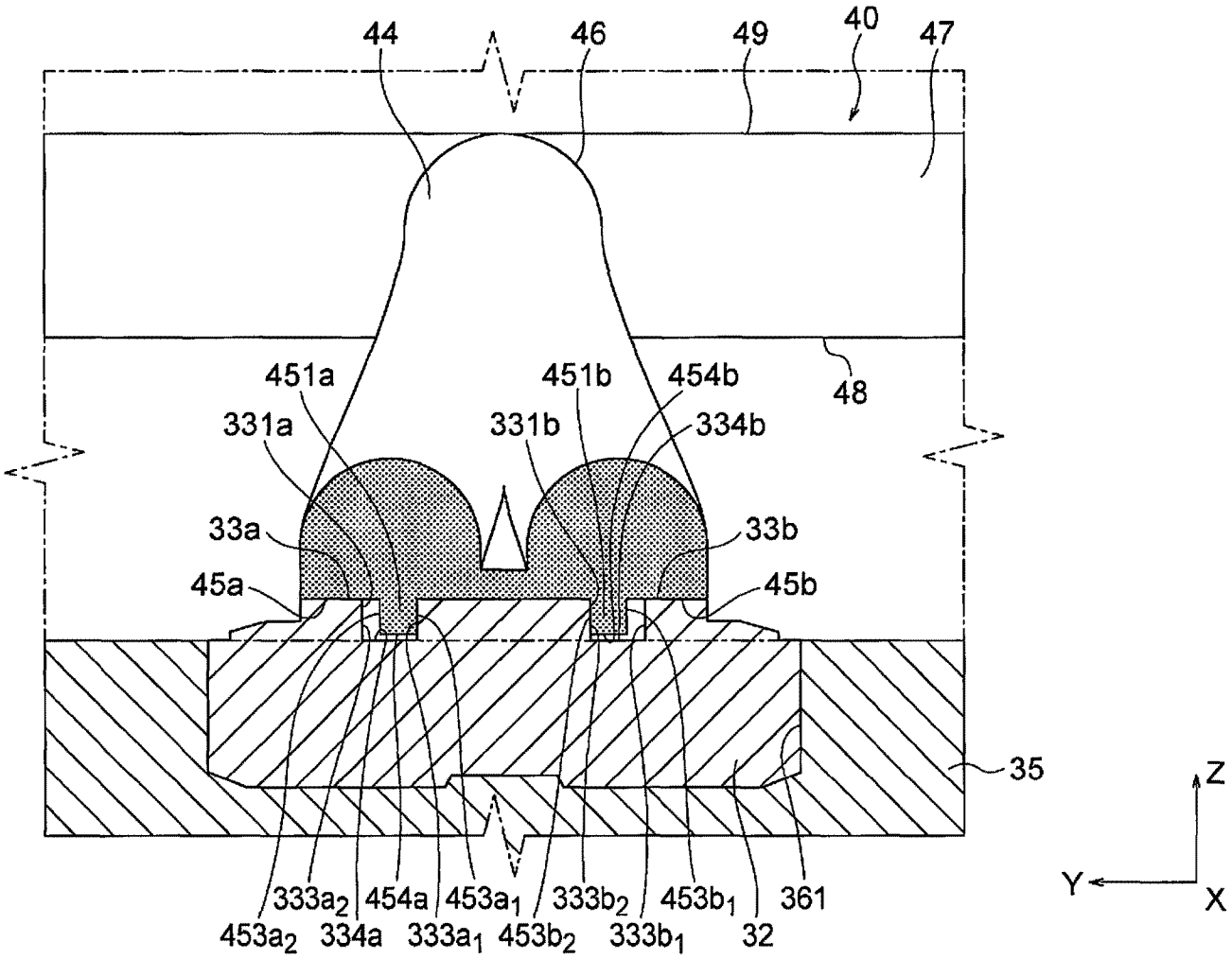
FIG. 6C is a cross-sectional view of the the port core as seen along line VIC-VIC of FIG. 5.
Figure 6D:
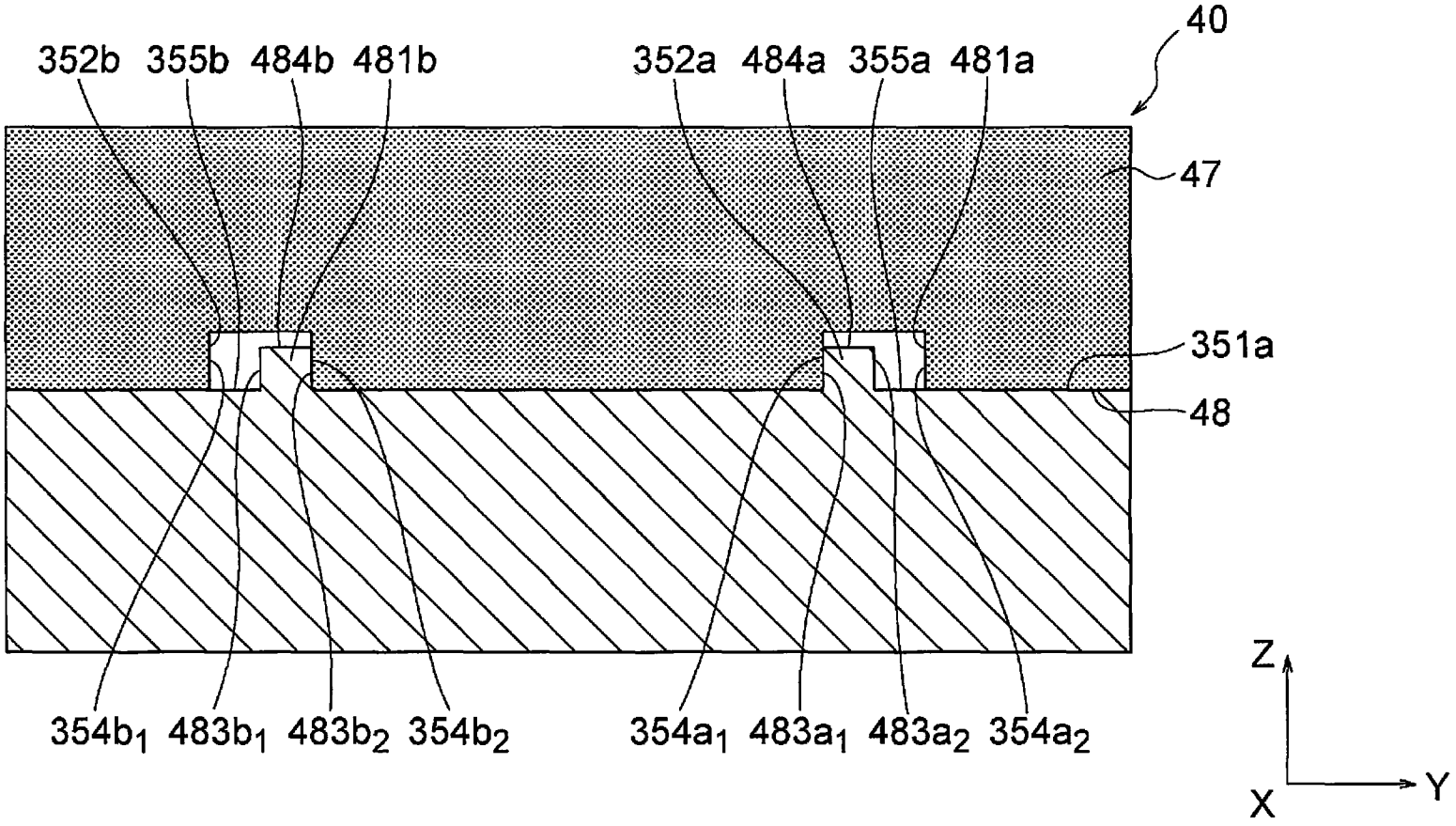
FIG. 6D is a cross-sectional view of the the port core as seen along line VID-VID of FIG. 5.

FIG. 5 is a plan view illustrating a state in which the port core is supported on a lower die according to the present invention; FIG. 6A is a cross-sectional view along line VIA-VIA of FIG. 5; FIG. 6B is a cross-sectional view along line VIB-VIB of FIG. 5; FIG. 6C is a cross-sectional view along line VIC-VIC of FIG. 5; and FIG. 6D is a cross-sectional view along line VID-VID line of FIG. 5.

In the cylinder head casting device 1 of the present embodiment, when the lower die 31 is made to support the port cores 40, 50, the positional relationship will be as shown in the plan view of FIG. 5. In the chamber insert 32 and the first body part 41 of the intake port core 40, which are positioned in the upper portion of the figure, one first intake side protrusion 421*a* of the pair of first intake side protrusions formed at the distal end 42*a* of the first body part 41 is fitted to one first intake side recess 331*a* of the pair of first intake side recesses formed on the intake hole formation surface 33*a* of the chamber insert 32 that corresponds to the first intake side protrusion 421*a*. In addition, the other first intake side protrusion 421*b* of the pair of first intake side protrusions formed at the distal end 42*b* of the first body part 41 is fitted to the other first intake side recess 331*b* of the pair of first intake side recesses formed on the intake hole formation surface 33*b* of the chamber insert 32 that corresponds to the first intake side protrusion 421*b*.

The first intake side protrusion 421*a* (that is, one first protrusion of the pair of first intake side protrusions 421*a*, 421*b*) has a smaller outer shape than the first intake side recess 331*a* (that is, one first recess of the pair of first intake side recesses 331*a*, 331*b*) in plan view. Additionally, this first intake side protrusion 421*a* is formed such that the center thereof is deviated from the center of the first intake side recess 331*a* in the −X direction in plan view. In the present Specification, "center" indicates a point corresponding to the center of gravity of the planar shape.

On the other hand, the first intake side protrusion 421*b* (that is, the other first protrusion of the pair of first intake side protrusions 421*a*, 421*b*) has a smaller outer shape than the first intake side recess 331*b* (that is, the other first recess of the pair of first intake side recesses 331*a*, 331*b*) in plan view. Additionally, this first intake side protrusion 421*b* is formed such that the center thereof is deviated from the center of the first intake side recess 331*b* in the +X direction in plan view.

In this manner, the pair of first intake side protrusions 421*a*, 421*b* are provided so as to separate from each other in the X direction (that is, a direction substantially perpendicular to the axial direction of the crankshaft CS) with respect to the first intake side recesses 331*a*, 331*b* to which the first intake side protrusions 421*a*, 421*b* are respectively fitted. Then, in the one first intake side protrusion 421*a* and first intake side recess 331*a*, the side surfaces 422*a*$_1$, 332*a*$_1$, which are one of the surfaces of the surfaces that are substantially parallel to the Y direction (that is, the axial direction of the crankshaft CS), are in contact; and in the other first intake side protrusion 421*b* and first intake side recess 331*b*, the side surfaces 422*b*$_2$, 332*b*$_2$, which are the other surfaces of the surfaces that are substantially parallel to the Y direction, are in contact. As a result, minute movement of the intake port core 40 is restricted in the X direction at the intake hole formation surfaces 33*a*, 33*b* and the distal ends 42*a*, 42*b* of the intake port core 40 that come in contact with each other.

The "inner side surfaces 332*a*$_1$, 332*b*$_2$" of the present embodiment correspond to one example of the "contact surface of the first engagement portion" in the present invention, and the "outer side surfaces 422*a*$_1$, 422*b*$_2$" correspond to one example of the "contact surface of the second engagement portion."

In the first intake side protrusion 421*a* and the first intake side recess 331*a*, which are fitted to each other, the height of the first intake side protrusion 421*a* has a smaller value than the depth of the first intake side recess 331*a*, as illustrated in FIG. 6A. That is, the first intake side protrusion 421*a* is loosely fitted to the first intake side recess 331*a* such that the top surface 424*a* thereof does not come in contact with the bottom surface 334*a* of the first intake side recess 331*a*. Similarly, in the first intake side protrusion 421*b* and the first intake side recess 331*b*, which are fitted to each other, the height of the first intake side protrusion 421*b* has a smaller value than the depth of the first intake side recess 331*b*, as illustrated in FIG. 6B. That is, the first intake side protrusion 421*b* is loosely fitted to the first intake side recess 331*b* such that the top surface 424*b* thereof does not come in contact with the bottom surface 334*b* of the first intake side recess 331*b*.

By loosely fitting the first intake side protrusions 421*a*, 421*b* to the first intake side recesses 331*a*, 331*b* in this manner, it is possible to prevent destruction of the intake port core 40 after injecting the molten metal L, caused by the difference between the thermal expansion coefficient of the material that forms the casting mold 30 and the thermal expansion coefficient of the material that forms the intake port core 40. That is, when the molten metal L is injected into the cavity S, the casting mold 30 and the intake port core 40 that face the molten metal L are heated and expanded. At this time, since a difference occurs in the degrees of thermal expansion between the casting mold 30 and the intake port core 40, there is a risk that the intake port core 40 will be crushed. In contrast, by loosely fitting the first intake side protrusions 421*a*, 421*b* to the first intake side recesses 331*a*, 331*b*, as in the present embodiment, clearance margins are ensured between the first intake side protrusion 421*a* and the first intake side recess 331*a*, as well as between the first intake side protrusion 421*b* and the first intake side recess 331*b*. The thermally expanded casting mold 30 and intake port core 40 enter these clearance margins to prevent the destruction of the intake port core 40.

Returning to FIG. 5, also in the chamber insert 32 and the first body part 41 of the intake port core 40, which are positioned below in the figure, in the same manner as described above, the outer side surface 422$a_1$ of one first intake side protrusion 421*a* of the pair of first intake side protrusions and the inner side surface 332$a_1$ of one first intake side recess 331*a* of the pair of first intake side recesses come in contact with each other, and the outer side surface 422$b_2$ of the other first intake side protrusion 421*b* of the pair of first intake side protrusions and the inner side surface 332$b_2$ of one first intake side recess 331*b* of the pair of first intake side recesses come in contact with each other. As a result, minute movement of the intake port core 40 is restricted in the X direction at the intake hole formation surfaces 33*a*, 33*b* and the distal ends 42*a*, 42*b* of the first body part 41 positioned at two ends of the intake port core 40. The first intake side protrusions 421*a*, 421*b* are also loosely fitted to the first intake side recesses 331*a*, 331*b* in this chamber insert 32 and the first body part 41, which are positioned below.

In contrast, in the chamber insert 32 and the second body part 44 of the intake port core 40, one first intake side protrusion 451*a* of the pair of first intake side protrusions formed at the distal end 45*a* of the second body part 44 is fitted to one first intake side recess 331*a* of the pair of first intake side recesses formed on the intake hole formation surface 33*a* of the chamber insert 32 that corresponds to the first intake side protrusion 451*a*. In addition, the other first intake side protrusion 451*b* of the pair of first intake side protrusions formed at the distal end 45*b* of the second body part 44 is fitted to the other first intake side recess 331*b* of the pair of first intake side recesses formed on the intake hole formation surface 33*b* of the chamber insert 32 that corresponds to the first intake side protrusion 451*b*.

The first intake side protrusion 451*a* (that is, one first protrusion of the pair of first intake side protrusions 451*a*, 451*b*) has a smaller outer shape than the first intake side recess 331*a* (that is, one first recess of the pair of first intake side recesses 331*a*, 331*b*) in plan view. Additionally, this first intake side protrusion 451*a* is formed such that the center thereof is deviated from the center of the first intake side recess 331*a* in the −Y direction in plan view.

On the other hand, the first intake side protrusion 451*b* (that is, the other first protrusion of the pair of first intake side protrusions 451*a*, 451*b*) has a smaller outer shape than the first intake side recess 331*b* (that is, the other first recess of the pair of first intake side recesses 331*a*, 331*b*) in plan view. Additionally, this first intake side protrusion 451*b* is formed such that the center thereof is deviated from the center of the first intake side recess 331*b* in the +Y direction in plan view.

In this manner, the pair of first intake side protrusions 451*a*, 451*b* are provided so as to approach each other in the Y direction with respect to the first intake side recesses 331*a*, 331*b* to which the first intake side protrusions 451*a*, 451*b* are respectively fitted, as illustrated in FIG. 6C. Then, in the one first intake side protrusion 451*a* and first intake side recess 331*a*, the side surfaces 453$a_1$, 333$a_1$, which are one of the surfaces of the surfaces that are substantially parallel to the X direction, are in contact; and in the other first intake side recess 451*b* and first intake side recess 331*b*, the side surfaces 453$b_2$, 333$b_2$, which are the other surfaces of the surfaces that are substantially parallel to the X direction, are in contact. As a result, vibrations of the distal ends 45*a*, 45*b* of the second body part 44 are suppressed. That is, the second body part 44 is a member extending along the X direction, in which the proximal end 46 side is a fixed end and the distal ends 45*a*, 45*b* side is a free end, but has a structure in which the distal ends 45*a*, 45*b* are easily vibrated. That is, the dimensional accuracy of the molded intake port IP is further improved by restricting the lateral shaking (vibration) of the second body part 44 along the Y direction rather than restricting the expansion and contraction of the second body part 44 in the extending direction (X direction).

The "inner side surfaces 333$a_1$, 333$b_2$" of the present embodiment correspond to one example of the "contact surface of the fifth engagement portion" in the present invention, and the "outer side surfaces 453$a_1$, 453$b_2$" correspond to one example of the "contact surface of the sixth engagement portion" in the present invention.

In the first intake side protrusion 451*a* and the first intake side recess 331*a*, which are fitted to each other, the height of the first intake side protrusion 451*a* has a smaller value than the depth of the first intake side recess 331*a*. That is, the first intake side protrusion 451*a* is loosely fitted to the first intake side recess 331*a* such that the bottom surface 454*a* thereof does not come in contact with the bottom surface 334*a* of the first intake side recess 331*a*. Similarly, in the first intake side protrusion 451*b* and the first intake side recess 331*b*, which are fitted to each other, the height of the first intake side protrusion 451*b* has a smaller value than the depth of the first intake side recess 331*b*. That is, the first intake side protrusion 451*b* is loosely fitted to the first intake side recess 331*b* such that the bottom surface 454*b* thereof does not come in contact with the bottom surface 334*b* of the first intake side recess 331*b*.

By loosely fitting the first intake side protrusions 451*a*, 451*b* to the first intake side recesses 331*a*, 331*b* in this manner, it is possible to prevent destruction of the intake port core 40 after injecting the molten metal L, caused by the difference between the thermal expansion coefficient of the material that forms the casting mold 30 and the thermal expansion coefficient of the material that forms the intake port core 40, in the same manner as when loosely fitting the first intake side protrusions 421*a*, 421*b* to the first intake side recesses 331*a*, 331*b*, as described above.

Returning to FIG. 5, in the mother die 35 and the base part 47 of the intake port core 40, one second intake side protrusion 352*a* of the pair of second intake side protrusions formed on the intake port core support surface 351*a* of the mother die 35 is fitted to one second intake side recess 481*a* of the pair of second intake side recesses formed on the lower surface 48 of the base part 47 that corresponds to the second intake side protrusion 352*a*. In addition, the other second intake side protrusion 352*b* of the pair of second intake side protrusions formed on the intake port core support surface 351*a* of the mother die 35 is fitted to the other second intake side recess 481*b* of the pair of second intake side recesses formed on the lower surface 48 of the base part 47 that corresponds to the second intake side protrusion 352*b*.

The second intake side protrusion 352*a* (that is, one second protrusion of the pair of second intake side protrusions 352*a*, 352*b*) has a smaller outer shape than the second intake side recess 481*a* (that is, one second recess of the pair of second intake side recesses 481*a*, 481*b*) in plan view. Additionally, this second intake side protrusion 352*a* is formed such that the center thereof is deviated from the center of the second intake side recess 481*a* in the −Y direction in plan view.

In contrast, the second intake side protrusion 352*b* (that is, the other second protrusion of the pair of first intake side protrusions 352*a*, 352*b*) has a smaller outer shape than the second intake side recess 481*b* (that is, the other second recess of the pair of first intake side recesses 481*a*, 481*b*) in plan view. Additionally, this second intake side protrusion 352*b* is formed such that the center thereof is deviated from the center of the second intake side recess 481*b* in the +Y direction in plan view.

In this manner, the pair of second intake side protrusions 352*a*, 352*b* are provided so as to approach each other in the Y direction with respect to the second intake side recesses 481*a*, 481*b* to which the second intake side protrusions are respectively fitted, as illustrated in FIG. 6D. Then, in the one second intake side protrusion 352*a* and second intake side recess 481*a*, the side surfaces 354$a_1$, 483$a_1$, which are one of the surfaces of the surfaces that are substantially parallel to the X direction, are in contact; and in the other second intake side recess 352*b* and second intake side recess 481*b*, the side surfaces 354$b_2$, 483$b_2$, which are the other surfaces of the surfaces that are substantially parallel to the X direction, are in contact. As a result, minute movement of the intake port core 40 is restricted in the Y direction at the intake port core support surface 351*a* and the lower surface 48 of the intake port core 40 that come in contact with each other.

The "inner side surfaces 483$a_1$, 483$b_2$" of the present embodiment correspond to one example of the "contact surface of the third engagement portion" in the present invention, and the "outer side surfaces 354$a_1$, 354$b_2$" correspond to one example of the "contact surface of the fourth engagement portion" in the present invention.

In the second intake side protrusion 352*a* and the second intake side recess 481*a*, which are fitted to each other, the height of the second intake side protrusion 352*a* has a smaller value than the depth of the second intake side recess 481*a*. That is, the second intake side protrusion 352*a* is loosely fitted to the second intake side recess 481*a* such that the top surface 355*a* thereof does not come in contact with the bottom surface 484*a* of the second intake side recess 481*a*. Similarly, in the second intake side protrusion 352*b* and the second intake side recess 481*b*, which are fitted to each other, the height of the second intake side protrusion 352*b* has a smaller value than the depth of the second intake side recess 481*b*. That is, the second intake side protrusion 352*b* is loosely fitted to the second intake side recess 481*b* such that the top surface 355*b* thereof does not come in contact with the bottom surface 484*b* of the second intake side recess 481*b*.

By loosely fitting the second intake side protrusions 352*a*, 352*b* to the second intake side recesses 481*a*, 481*b* in this manner, it is possible to prevent destruction of the intake port core 40 after injecting the molten metal L, caused by the difference between the thermal expansion coefficient of the material that forms the casting mold 30 and the thermal expansion coefficient of the material that forms the intake port core 40, in the same manner as when loosely fitting the first intake side protrusions 421*a*, 421*b* to the first intake side recesses 331*a*, 331*b*, as described above.

In the right die 38*a* and the base part 47 of the intake port core 40, the upper surface 49 of the base part 47, which is an inclined surface, comes in contact with the intake port core pressing surface 381*a* of the right die 38*a*, which is an inclined surface that corresponds to the upper surface 49. By this intake port core pressing surface 381*a* of the right die 38*a* pressing the upper surface 49 downward (that is, to the intake port core support surface 351*a* side of the mother die 35), minute movement of the intake port core 40 is restricted the Z direction (that is, the axial direction of the cylinders C of the internal combustion engine EG).

As described above, while exhibiting some difference in shape from the intake port core 40, the exhaust port core 50 has basically the same structure that is mirror-symmetrical with the intake port core 40; therefore, a detailed description thereof is omitted. In the cylinder head casting device 1, it is possible to obtain the same action as the above-described intake port core 40 with this exhaust port core 50 as well.

For convenience, the parts of the exhaust port core 50 are identified with the following reference numbers. 52*a* and 52*b* are distal ends of body part 51. 55*a* and 55*b* are distal ends of body part 56. 53 is a proximal end of body part 51. 56 is a proximal end of body part 54. 58 is a lower surface of the base part 57. 521*a* and 521*b* are intake side protrusions formed at the distal ends 52*a* and 52*b* of first body part 51. The intake-side protrusion 521*a* comprises four outer side surfaces 522$a_1$, 522$a_2$, 523$a_1$, 523$a_2$ and a top surface 524*a*. The intake-side protrusion 521*b* comprises four outer side surfaces 522$b_1$, 522$b_2$, 523$b_1$, 523$b_2$, and a top surface 524*b*. 551*a* and 551*b* are intake side protrusions formed at distal ends 52*a* and 52*b* of body part 51. The intake side protrusion 551*a* comprises outer side surfaces 552$a_1$ and 552$a_2$ and outer side surfaces 553$a_1$ and 553$a_2$. The intake side protrusion 551*b* comprises outer side surfaces 552$b_1$ and 552$b_2$, and outer side surfaces 553*b*1 and 553$b_2$. 581*a* and 581*b* are intake side recesses formed on the lower surface 58. The intake-side second recess 581*a* comprises four inner side surfaces 582$a_1$, 582$a_2$, 583$a_1$,583$a_2$ and a bottom surface 584*a*. The intake-side second recess 581*b* comprises four inner side surfaces 582$b_1$, 582$b_2$, 583$b_1$, 583$b_2$, and a bottom surface 584*b*.

Figure 7A:
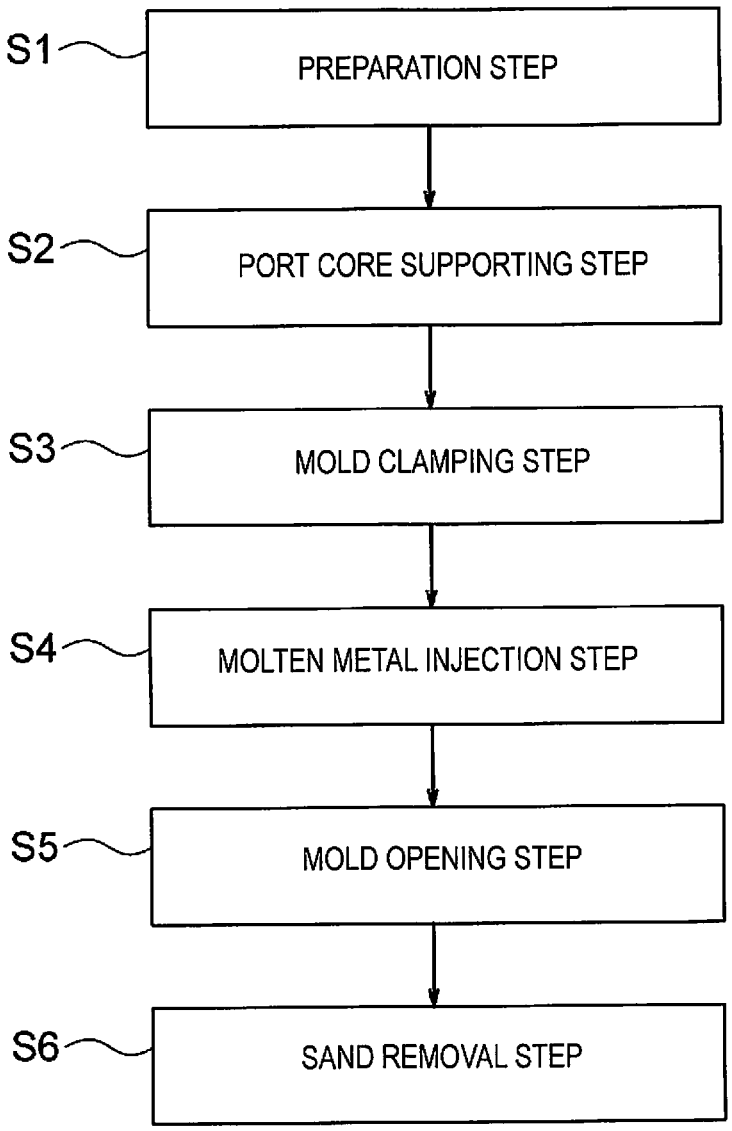
FIG. 7A is a process view illustrating a cylinder head casting method for casting a cylinder head according to one embodiment of the present invention.
Figure 7B:
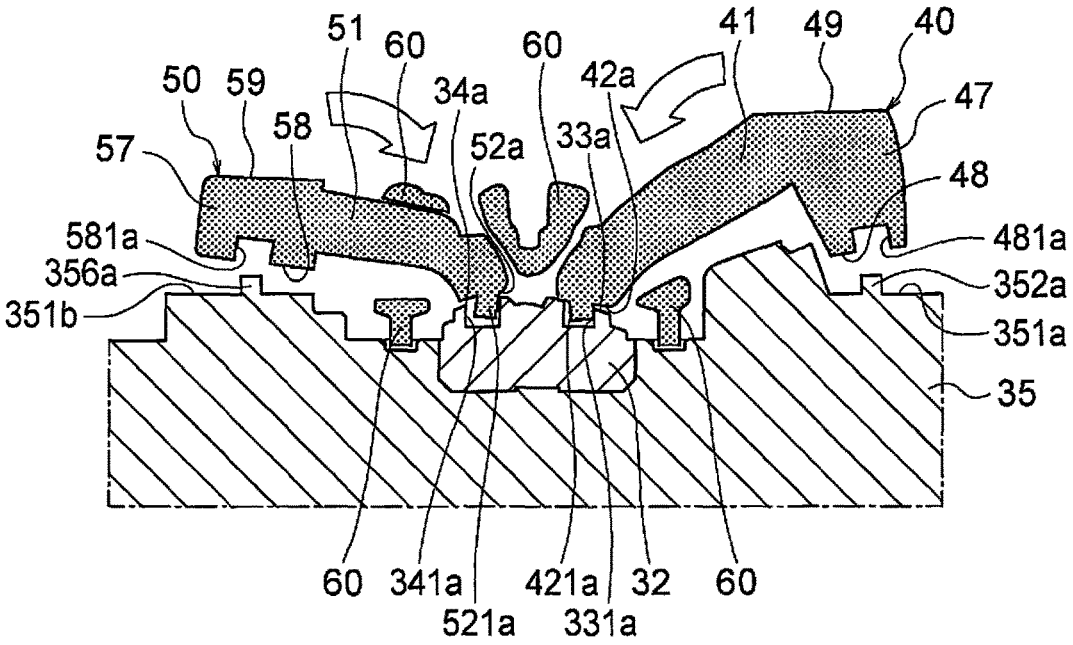
FIG. 7B is a cross-sectional view for explaining a core supporting step (part 1) according to one embodiment of the present invention.
Figure 7C:
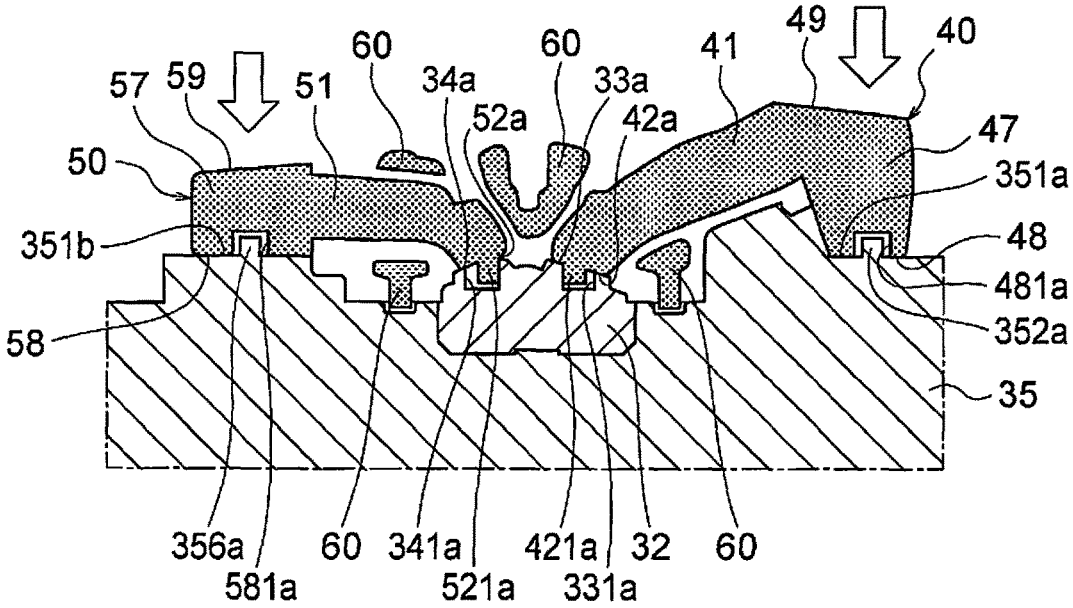
FIG. 7C is a cross-sectional view for explaining a core supporting step (part 2) according to one embodiment of the present invention.
Figure 7D:
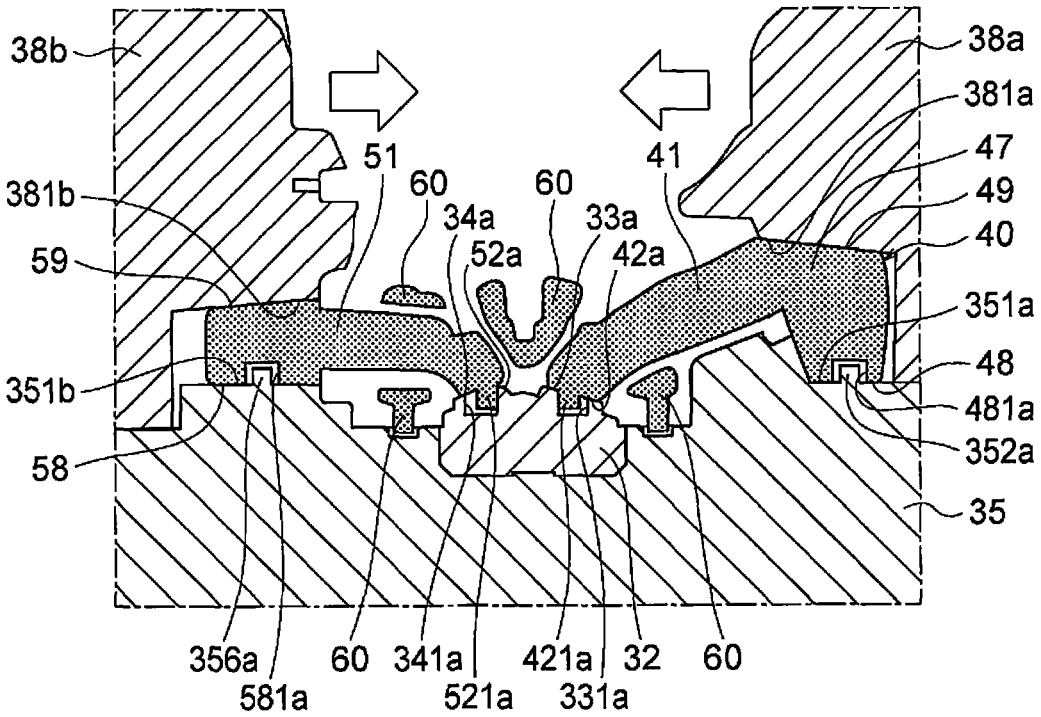
FIG. 7D is a cross-sectional view for explaining a core supporting step (part 3) according to one embodiment of the present invention.

Next, the method for casting a cylinder head CH using the cylinder head casting device 1 according to the present embodiment will be described in detail. FIG. 7A is a process view illustrating a method for casting a cylinder head according to one embodiment of the present invention; FIG. 7B is a cross-sectional view for explaining a core supporting step (part 1) according to one embodiment of the present invention; FIG. 7C is a cross-sectional view for explaining a core supporting step (part 2) according to one embodiment of the present invention; and FIG. 7D is a cross-sectional view for explaining a core supporting step (part 3) according to one embodiment of the present invention.

The method for casting a cylinder head CH according to the present embodiment comprises a preparation Step S1, a port core supporting Step S2, a mold clamping Step S3, a molten metal injection Step S4, a mold opening Step S5, and a sand removal Step S6, as illustrated in FIG. 7A. The "preparation Step S1" of the present embodiment corresponds to one example of the "preparation step" in the present invention; the "port core supporting Step S2" of the present embodiment corresponds to one example of the "core supporting step" in the present invention; and the "molten metal injection Step S4" of the present embodiment corresponds to one example of the "molten metal injection step" in the present invention.

First, in the preparation Step S1, the casting mold 30 and the cores 40, 50, 60, 70 of the present embodiment are prepared. Then, the protrusion 363 of the mother die 35 prepared in the preparation Step S1 is engaged with the groove 121*a* of the platen 12 to fix the mother die 35. Then, the chamber insert 32 is fitted in the fitting groove 361 of the mother die 35 that is fixed to the platen 12. The chamber insert 32 may be fitted in advance before the mother die 35 is fixed to the platen 12. Then, the jacket core 60 is mounted on the jacket core support groove 362 of the mother die 35.

Next, in the port core supporting Step S2, the intake/exhaust port cores 40, 50 are supported by the casting mold 30. Here, the step for supporting the intake port core 40 to the casting mold 30 will be described. First, the distal end of each body part of the intake port core 40 is abutted against the intake hole formation surface of the chamber insert 32, as illustrated in FIG. 7B. At the distal ends 42*a*, 42*b* of the first body part 41 positioned at both ends of the intake port core 40 and on the intake hole formation surfaces 33*a*, 33*b* of the chamber insert 32, the first intake side protrusion 421*a* formed at the distal end 42*a* enters the first intake side recess 331*a* formed on the intake hole formation surface 33*a*, and the first intake side protrusion 421*b* formed at the distal end 42*b* enters the first intake side recess 331*b* formed on the intake hole formation surface 33*b*. Also at the distal ends 45*a*, 45*b* of the second body part 44 positioned at the center of the intake port core 40 and on the intake hole formation surfaces 33*a*, 33*b* of the chamber insert 32, the first intake side protrusion 451*a* enters the first intake side recess 331*a*, and the first intake side protrusion 451*b* enters the first intake side recess 331*b*, in the same manner as described above.

Then, the lower surface 48 of the base part 47 of the intake port core 40 is abutted against the intake port core support surface 351*a* of the mother die 35, as illustrated in FIG. 7C. On the lower surface 48 of the base part 47 and the intake port core support surface 351*a* of the mother die 35, the second intake side protrusion 352*a* formed on the intake port core support surface 351*a* enters the second intake side recess 481*a* formed on the lower surface 48, and the second intake side protrusion 352*b* enters the second intake side recess 481*b*. Then, by pressing the lower surface 48 of the base part 47 against the intake port core support surface 351*a* of the mother die 35, the second intake side protrusion 352*a* is fitted to the second intake side recess 481*a*, such that the outer side surface 354$a_1$ of the second intake side protrusion 352*a* and the inner side surface 483$a_1$ of the second intake side recess 481*a* come in contact with each other (refer to FIG. 5 and FIG. 6D). Similarly, the second intake side protrusion 352*b* is fitted to the second intake side recess 481*b*, such that the outer side surface 354$b_2$ of the second intake side protrusion 352*b* and the inner side surface 483$b_2$ of the second intake side recess 481*b* come in contact with each other (refer to FIG. 5 and FIG. 6D). Minute movement of the intake port core 40 is thereby restricted in the Y direction (that is, the direction substantially parallel to the axial direction of the crankshaft CS).

Concurrently with the intake port core 40 being positioned in the Y direction as described above, the intake port core 40 is also positioned on the intake hole formation surface of the chamber insert 32 and at the distal end of each body part. That is, in the first body part 41, the second intake side protrusion 421*a* is fitted to the first intake side recess 331*a*, such that the outer side surface 422$a_1$ of the first intake side protrusion 421*a* and the inner side surface 332$a_1$ of the first intake side recess 331*a* come in contact with each other (refer to FIG. 5 and FIG. 6A). Similarly, the first intake side protrusion 421*b* is fitted to the first intake side recess 331*b*, such that the outer side surface 422$b_2$ of the first intake side protrusion 421*b* and the inner side surface 332$b_2$ of the first intake side recess 331*b* come in contact with each other (refer to FIG. 5 and FIG. 6B). Minute movement of the intake port core 40 is thereby restricted in the X direction (that is, the direction substantially perpendicular to the axial direction of the crankshaft CS). In the second body part 44, vibration of the second body part 44 is suppressed by one of the side surfaces 453$a_1$, 333$a_1$ coming into contact in one first intake side protrusion 451*a* and first intake side recess 331*a*, which are fitted to each other, and by the other side surfaces 453$b_2$, 333$b_2$ coming into contact in the other first intake side protrusion 451*b* and first intake side recess 331*b*, which are fitted to each other. The intake port core 40 is thereby supported at a predetermined position on the lower die 31 in plan view.

Next, the left and right dies 38*a*, 38*b* and the front and rear dies 39*a*, 39*b* of the casting mold 30 are fitted, as illustrated in FIG. 7D. When the right die 38*a* is moved from the retracted position to the mold clamping position (that is, in the −X direction), the intake port core pressing surface 381*a* of the right die 38*a* and the upper surface 49 of the base part 47 come in contact with each other. Since the upper surface 49 and the intake port core pressing surface 381*a* are inclined surfaces that are inclined so as to approach the lower die 31 as the distance from the distal end of the body part is increased, with the movement of the right die 38*a* toward the −X direction, the intake port core pressing surface 381*a* presses the base part 47, which is in contact, downward (that is, to the lower die 31 side), and the intake port core 40 is positioned in the Z direction (that is, the axial direction of the cylinders C of the internal combustion engine EG). The intake port core 40 is thereby supported at a predetermined position in the casting mold 30. In addition to supporting the intake port core 40, the exhaust port core 50 is also supported in the casting mold 30. This exhaust port core 50 is supported at a predetermined position in the casting mold 30 by a step that is similar to the step for supporting the intake port core 40 described above.

After the port core supporting Step S2, the top core 70 is loaded in the casting mold 30, and the upper die 37 is fitted. Next, in the mold clamping Step S3, clamping by the lower die 31, the upper die 37, the left and right dies 38*a*, 38*b*, and the front and rear dies 39*a*, 39*b* of the casting mold 30 is carried out, and a cavity S is defined inside the casting mold 30. Next, in the molten metal injection Step S4, molten metal L is injected into the cavity S. In the mold opening Step S5 after the molten metal is solidified, the pressing devices 13-17 are driven, and each of the casting molds 37, 38*a*, 38*b*, 39*a*, 39*b* are returned to the retracted positions away from the clamping position, to open the casting mold 30. Next, in the sand removal Step S6, a cylinder head CH can be obtained by removing sand from each of the cores 40, 50, 60, 70.

The cylinder head casting device 1 and the method for casting a cylinder head according to the present embodiment exert the following effects.

(1) In the present embodiment, an intake port core 40 is supported in a state in which distal ends 42*a* and 42*b*, 45*a* and 45*b*, 42*a* and 42*b* of body parts 41, 44, 41 of the intake port core 40 are placed in contact with intake hole formation surfaces 33*a*, 33*b* of a chamber insert 32, a lower surface 48 of a base part 47 of the intake port core 40 is placed in contact with an intake port core support surface 351*a* of a mother die 35, and an upper surface 49 of the base part 47 is placed in contact with an intake port core pressing surface 381*a* of a right die 38*a*. Minute movement of the intake port core 40 is thereby restricted, and reduction of the positioning accuracy of the intake port core 40 is suppressed.

(2) Additionally, according to the present embodiment, at distal ends 42*a*, 42*b* of the first body part 41 of the intake port core 40 and on the intake hole formation surfaces 33*a*, 33*b* of the chamber insert 32, a pair of first intake side protrusions 421*a*, 421*b* are formed at the distal ends 42*a*, 42*b*, and a pair of first intake side recesses 331*a*, 331*b*, which are respectively loosely fitted with the pair of first intake side protrusions 421*a*, 421*b*, are formed on the intake hole formation surfaces 33*a*, 33*b*. Then, in a state in which an outer side surface 422$a_1$ of one first intake side protrusion 421*a* of the pair of first intake side protrusions and an inner side surface 332$a_1$ of a first intake side recess 331*a* that corresponds to the first intake side protrusion 421*a* come in contact with one of the surfaces that are substantially parallel to the Y direction (that is, substantially parallel with respect to the axial direction of the crankshaft CS), and an outer side surface 422$b_2$ of the other first intake side protrusion 421*b* of the pair of first intake side protrusions and an inner side surface 332$b_2$ of a first intake side recess 331*b* that corresponds to the first intake side protrusion 421*b* come in contact with the other of the surfaces that are substantially parallel to the Y direction, minute movement of the intake port core 40 is restricted in the X direction (that is, the direction substantially perpendicular to the axial direction of the crankshaft CS), and reduction of the positioning accuracy of the intake port core 40 is further suppressed by supporting the first body part 41 in the cavity S.

(3) In addition, according to the present embodiment, on the lower surface 48 of the base part 47 of the intake port core 40 and the intake port core support surface 351*a* of the mother die 35, a pair of second intake side protrusions 352*a*, 352*b* are formed on the intake port core support surface 351*a*, and second intake side recesses 481*a*, 481*b*, which are respectively loosely fitted to the pair of second intake side protrusions 352*a*, 352*b*, are formed on the lower surface 48. Then, in a state in which an outer side surface 354$a_1$ of one second intake side protrusion 352*a* of the pair of second intake side protrusions and an inner side surface 483$a_1$ of a second intake side recess 481*a* that corresponds to the second intake side protrusion 352*a* come in contact with one of the surfaces that are substantially parallel to the X direction (that is, substantially perpendicular with respect to the axial direction of the crankshaft CS), and an outer side surface 354$b_2$ of the other second intake side protrusion 352*b* of the pair of second intake side protrusions and an inner side surface 483$b_2$ of a second intake side recess 481*b* that corresponds to the second intake side protrusion 352*b* come in contact with the other of the surfaces that are substantially parallel to the X direction, minute movement of the intake port core 40 is restricted in the Y direction (that is, the direction substantially parallel to the axial direction of the crankshaft CS), and reduction in the positioning accuracy of the intake port core 40 is further suppressed by supporting the base part 47 by the casting mold 30.

(4) Additionally, in the present embodiment, the internal combustion engine EG is a three-cylinder internal combustion engine, the body parts corresponding to the cylinders C1, C3 positioned at the two ends of the cylinders C of the internal combustion engine are the first body part 41, and the body part corresponding to the remaining cylinder C2 (that is, here, the body part other than the first body part 41) is the second body part 44. Then, at distal ends 45*a*, 45*b* of the second body part 44 and on the intake hole formation surfaces 33*a*, 33*b* of the chamber insert 32, a pair of first intake side protrusions 451*a*, 451*b* are formed at the distal ends 45*a*, 45*b*, and a pair of first intake side recesses 331*a*, 331*b*, which are respectively loosely fitted with the pair of first intake side protrusions 451*a*, 451*b*, are formed on the intake hole formation surfaces 33*a*, 33*b*. In a state in which an outer side surface 453$a_1$ of one first intake side protrusion 451*a* of the pair of first intake side protrusions and an inner side surface 333$a_1$ of a first intake side recess 331*a* that corresponds to the first intake side protrusion 451*a* come in contact with one of the surfaces that are substantially parallel to the X direction (that is, substantially perpendicular with respect to the axial direction of the crankshaft CS), and an outer side surface 453$b_2$ of the other first intake side protrusion 451*b* of the pair of first intake side protrusions and an inner side surface 333$b_2$ of a first intake side recess 331*b* that corresponds to the first intake side protrusion 451*b* come in contact with the other of the surfaces that are substantially parallel to the X direction, minute movement of the intake port core 40 is restricted in the X direction (that is, the direction substantially perpendicular to the axial direction of the crankshaft CS), and vibration of the second body part 44 can be suppressed.

(5) When supporting the exhaust port core 50 as well, a similar effect as the above-described intake port core 40 can be exerted by the cylinder head casting device 1 and the method for casting a cylinder head according to the present embodiment.

(6) Additionally, it is possible to achieve an improvement in the fuel efficiency of the internal combustion engine EG having a cylinder head CH molded using the cylinder head casting device 1 and the method for casting a cylinder head according to the present embodiment. That is, the intake/exhaust ports IP, EP of the cylinder head CH molded by the cylinder head casting device 1 and the method for casting a cylinder head according to the present embodiment have good dimensional accuracy corresponding to the intake/exhaust port cores 40, 50 that have been positioned in a highly accurate manner. Thus, it is possible to suppress a level difference occurring at the connecting portion with the intake/exhaust manifold in the intake/exhaust ports IP, EP caused by misalignment. It is thereby possible to suppress an occurrence of disturbance in the flow of the intake air-fuel mixture that flows down inside the intake port IP and the flow of the exhaust that flows down inside the exhaust port EP caused by a level difference, which in turn improves the fuel efficiency of the internal combustion engine EG.

(7) Additionally, in the intake port IP, based on a theoretical value (design value) of the volume inside the intake port IP, a predetermined amount of fuel in the vicinity of stoichiometry with respect to the theoretical value is injected from the fuel injection valve; however, if the actual volume inside the intake port IP is a value that is different from the above-described theoretical value, the air-fuel ratio in the intake air-fuel mixture inside the intake port IP will deviate from the theoretical air/fuel ratio, which in turn could deteriorate the fuel efficiency of the internal combustion engine EG. In contrast, in the present embodiment, by positioning the intake port core 40 in a highly accurate manner, it is possible to bring the actual volume of the molded intake port IP to the theoretical value, and, by extension, it is possible to suppress deterioration of the fuel efficiency of the internal combustion engine EG.

(8) Additionally, in the exhaust port EP, based on a theoretical value of the volume inside the exhaust port EP, an exhaust catalyst that purifies the exhaust gas in the vicinity of stoichiometry is provided; however, if the actual volume inside the exhaust port EP is a value that is different from the above-described theoretical value, the amount of exhaust gas that flows down inside the exhaust port EP will deviate from the theoretical value, which in turn could deteriorate the exhaust purification performance of the exhaust catalyst. In contrast, in the present embodiment, by positioning the exhaust port core 50 in a highly accurate manner, it is possible to bring the actual volume of the molded exhaust port EP to the theoretical value, and, by extension, it is possible to suppress deterioration of the exhaust purification catalyst performance of the exhaust catalyst.

The foregoing embodiments have been described in order to facilitate understanding of the present invention and do not limit the present invention. Therefore, the elements disclosed in the above-described embodiments are intended to include all design modifications and equivalents thereto that lie within the technical scope of the present invention.

In the present embodiment, a pair of first intake side protrusions 421*a*, 421*b* are formed at the distal ends 42*a*, 42*b* of the first body part 41 of the intake port core 40, and a pair of first intake side recesses 331*a*, 331*b* are formed on the intake hole formation surfaces 33*a*, 33*b* of the chamber insert 32, but no limitation is imposed thereby, and these first intake side protrusions and the first intake side recesses may be formed in opposite fashion. That is, a pair of first intake side protrusions may be formed on the intake hole formation surface of the chamber insert, and a pair of first intake side recesses may be formed at the distal end of the first body part 41. Also, in the second body part of the intake port core, a pair of second intake side recesses may be formed at the distal ends of the second body parts, and a pair of first intake side protrusions may be formed on the intake hole formation surface of the chamber insert.

In addition, in the present embodiment, a pair of second intake side protrusions 481*a*, 481*b* are formed on the lower surface 48 of the base part 47 of the intake port core 40, and a pair of second intake side protrusions 352*a*, 352*b* are formed on the intake port core support surface 351*a* of the mother die 35, but no limitation is imposed thereby, and these second intake side protrusions and the second intake side recesses may be formed in opposite fashion. That is, a pair of second intake side protrusions may be formed on the lower surface and a pair of second intake side recesses may be formed on the intake port core support surface.

Additionally, in the present embodiment, the lower die 31 comprises a chamber insert 32 and a mother die 35, and intake hole formation surfaces 33*a*, 33*b* and exhaust hole formation surfaces 34*a*, 34*b* are formed in the chamber insert 32, but no limitation is imposed thereby; the intake hole formation surfaces and the exhaust hole formation surfaces may be formed in the mother die 35 (that is, the lower die 31) without using a chamber insert. In this case, since the chamber insert 32 and the mother die 35 can be integrated, it is possible to reduce equipment costs. When using a chamber insert, it is possible to mold cylinder heads having different top portion shapes of the combustion chamber simply by replacing the chamber insert; therefore, when forming various types of cylinder heads, the casting process of the cylinder heads is simplified.

In addition, the internal combustion engine EG of the present embodiment is a three-cylinder internal combustion engine, and there is only one remaining cylinder C2, excluding the cylinders C1, C3 that are positioned at the two ends; however, if the internal combustion engine is a four-cylinder internal combustion engine having four cylinders, there will be two remaining cylinders, excluding the cylinders positioned at the two ends. In this case, the body parts of the intake port core that correspond to the remaining cylinders may both be the second body part, or, one may be the first body part and the other may be the second body part.

The invention claimed is:

1. A cylinder head casting device for casting a cylinder head of an internal combustion engine having a crankshaft and a plurality of cylinders that each includes a plurality of ports for air intake or exhaust, the cylinder head casting device comprising:

a casting mold comprising an upper die, a lower di; and side dies that relatively approach and move away from each other so as to define an interior cavity that corresponds to an outer shape of the cylinder head, and a casting core supported in the cavity, and comprising a plurality of body parts having outer shapes that respectively correspond to the plurality of ports and a base part that is integrally formed at proximal end sides of the plurality of body parts, the lower die comprising a first surface that corresponds to an opening surface of the ports on a combustion chamber side and a second surface that faces a lower surface of the base part, the side dies comprising a third surface that faces the second surface, the casting core being configured such that the body parts are supported in the cavity by distal ends of the body parts coming in contact with the first surface, the lower surface of the base part coming in contact with the second surface, and an upper surface of the base part coming in contact with the third surface, at least two first engagement portions having a contact surface that is substantially parallel to an axial direction of the crankshaft being formed on the first surface, at least two second engagement portions loosely fitted to the first engagement portions, respectively, to allow for expansion thereof, and each having a contact surface that is substantially parallel to the axial direction of the crankshaft being formed at the distal ends of the body parts, and the casting core being supported in the cavity in a state in which the contact surfaces of the first engagement portions and the contact surfaces of the second engagement portions are in contact with each other.

2. The cylinder head casting device according to claim 1, wherein the contact surfaces of the first engagement portions and the contact surfaces of the second engagement portions each includes two contact surfaces that are parallel to each other, and when one of the contact surfaces of the at least two of the second engagement portions formed at the distal ends of the body parts come in contact with one of the contact surfaces of the first engagement portions formed on the first surface on one side in a direction perpendicular to an axis of the crankshaft, the other of the contact surfaces of the at least two of the second engagement portions come in contact with the other of the contact surfaces of the first engagement portions on the other side in the direction perpendicular to the axis of the crankshaft.

3. The cylinder head casting device according to claim 2, wherein the lower die includes an insert having the first surface that corresponds to the opening surface of the ports on the combustion chamber side and a mother die to which the insert is fitted.

4. The cylinder head casting device according to claim 1, wherein the lower die includes an insert having the first surface that corresponds to the opening surface of the ports on the combustion chamber side and a mother die to which the insert is fitted.

5. A cylinder head casting device for casting a cylinder head of an internal combustion engine having a crankshaft and a plurality of cylinders that each includes a plurality of ports for air intake or exhaust, the cylinder head casting device comprising:

a casting mold comprising an upper die, a lower die, and side dies that relatively approach and move away from each other so as to define an interior cavity that corresponds to an outer shape of the cylinder head, and a casting core supported in the cavity, and comprising a plurality of body parts having outer shapes that respectively correspond to the plurality of ports and a base part that is integrally formed at proximal end sides of the plurality of body parts, the lower die comprising a first surface that corresponds to an opening surface of the ports on a combustion chamber side and a second surface that faces a lower surface of the base part, the side dies comprising a third surface that faces the second surface, the casting core being configured such that the body parts are supported in the cavity by distal ends of the body parts coming in contact with the first surface, the lower surface of the base part coming in contact with the second surface, and an upper surface of the base part coming in contact with the third surface, at least two third engagement portions having a contact surface that is substantially perpendicular to an axial direction of the crankshaft being formed on the lower surface of the base part, at least two fourth engagement portions loosely fitted to the third engagement portions, respectively, to allow for expansion thereof, and each having a contact surface that is substantially perpendicular to the axial direction of the crankshaft being formed on the second surface, the contact surfaces of the third engagement portions and the contact surfaces of the fourth engagement portions each including two contact surfaces that are parallel to each other, and when one of the contact surfaces of the at least two of the third engagement portions formed on the lower surface of the base part comes in contact with one of the contact surfaces of the fourth engagement portions formed on the second surface on one side in the axial direction of the crankshaft, the other of the contact surfaces of the at least two of the third engagement portions come in contact with the other of the contact surfaces of the fourth engagement portions on the other side in the axial direction of the crankshaft.

6. The cylinder head casting device according to claim 5, wherein the lower die includes an insert having the first surface that corresponds to the opening surface of the ports on the combustion chamber side and a mother die to which the insert is fitted.

7. A cylinder head casting device for casting a cylinder head of an internal combustion engine having a crankshaft and a plurality of cylinders that each includes a plurality of ports for air intake or exhaust, the cylinder head casting device comprising:

a casting mold comprising an upper die, a lower di; and side dies that relatively approach and move away from each other so as to define an interior cavity that corresponds to an outer shape of the cylinder head, and a casting core supported in the cavity, and comprising a plurality of body parts having outer shapes that respectively correspond to the plurality of ports and a base part that is integrally formed at proximal end sides of the plurality of body parts, the lower die comprising a first surface that corresponds to an opening surface of the ports on a combustion chamber side and a second surface that faces a lower surface of the base part, the side dies comprising a third surface that faces the second surface, the casting core being configured such that the body parts are supported in the cavity by distal ends of the body parts coming in contact with the first surface, the lower surface of the base part coming in contact with the second surface, and an upper surface of the base part coming in contact with the third surface, the internal combustion engine comprises three or more cylinders, at least two fifth engagement portions having a contact surface that is substantially perpendicular to an axial direction of the crankshaft being formed on the first surface that corresponds to second body parts other than first body parts that correspond to the cylinders positioned at least the two ends of the cylinder, at least two sixth engagement portions loosely fitted to the fifth engagement portions, respectively, to allow for expansion thereof, and each having a contact surface that is substantially perpendicular to the axial direction of the crankshaft being formed at the distal ends of the second body parts, the contact surfaces of the fifth engagement portions and the contact surfaces of the sixth engagement portions each including two contact surfaces that are parallel to each other, and when one of the contact surfaces of the at least two of the sixth engagement portions formed at the distal ends of the second body parts come in contact with one of the contact surfaces of the fifth engagement portions formed on the first surface on one side in the axial direction of the crankshaft, the other of the contact surfaces of the at least two of the sixth engagement portions come in contact with the other of the contact surfaces of the fifth engagement portions on the other side in the axial direction of the crankshaft.

8. The cylinder head casting device according to claim 7, wherein the lower die includes an insert having the first surface that corresponds to the opening surface of the ports on the combustion chamber side and a mother die to which the insert is fitted.

9. A cylinder head casting method for casting a cylinder head of an internal combustion engine having a crankshaft and a plurality of cylinders that each includes a plurality of ports for air intake or exhaust, the cylinder head casting method comprising:

a casting mold comprising an upper die, a lower die, and side dies that relatively approach and move away from each other so as to define a cavity inside that corresponds to the outer shape of the cylinder head, the lower die having a first surface that corresponds to an opening surface of the ports on a combustion chamber side and a second surface that faces a lower surface of a base part of a casting core, and the side dies having a third surface that faces the second surface, a preparation step for preparing the casting core that is supported in the cavity and that includes a plurality of body parts having outer shapes that respectively correspond to the plurality of ports, and a base part that is integrally formed at the proximal end sides of the plurality of body parts, a core supporting step in which the casting core is configured such that the body parts are supported in the cavity by distal ends of the body parts coming in contact with the first surface, the lower surface of the base part coming in contact with the second surface, and the upper surface of the base part coming in contact with the third surface, at least two first engagement portions having a contact surface that is substantially parallel to an axial direction of the crankshaft being formed on the first surface, at least two second engagement portions loosely fitted to the first engagement portions, respectively, to allow for expansion thereof, and each having a contact surface that is substantially parallel to the axial direction of the crankshaft being formed at the distal ends of the body parts, and the core supporting step including supporting the casting core inside the cavity in a state in which the contact surfaces of the first engagement portions and the contact surfaces of the second engagement portions are in contact with each other, and a molten metal injection step in which the casting mold is closed and molten metal is injected into the cavity.

10. The cylinder head casting method according to claim 9, wherein the lower die includes an insert having the first surface that corresponds to the opening surface of the ports on the combustion chamber side and a mother die to which the insert is fitted.

11. The cylinder head casting method according to claim 9, wherein the contact surfaces of the first engagement portions and the contact surfaces of the second engagement portions each includes two contact surfaces that are parallel to each other, and when one of the contact surfaces of the at least two of the second engagement portions formed at the distal end of the body parts come in contact with one of the contact surfaces of the first engagement portions formed on the first surface on one side in a direction perpendicular to an axis of the crankshaft, the core supporting step includes the other of the contact surfaces of the at least two of the second engagement portions coming in contact with the other of the contact surfaces of the first engagement portions on the other side in the direction perpendicular to the axis of the crankshaft.

12. The cylinder head casting method according to claim 11, wherein the lower die includes an insert having the first surface that corresponds to the opening surface of the ports on the combustion chamber side and a mother die to which the insert is fitted.

13. A cylinder head casting method for casting a cylinder head of an internal combustion engine having a crankshaft and a plurality of cylinders that each includes a plurality of ports for air intake or exhaust, the cylinder head casting method comprising:

a casting mold comprising an upper die, a lower die, and side dies that relatively approach and move away from each other so as to define a cavity inside that corresponds to the outer shape of the cylinder head, the lower die having a first surface that corresponds to an opening surface of the ports on a combustion chamber side and a second surface that faces a lower surface of a base part of a casting core, and the side dies having a third surface that faces the second surface, a preparation step for preparing the casting core that is supported in the cavity and that includes a plurality of body parts having outer shapes that respectively correspond to the plurality of ports, and a base part that is integrally formed at the proximal end sides of the plurality of body parts, a core supporting step in which the casting core is configured such that the body parts are supported in the cavity by distal ends of the body parts coming in contact with the first surface, the lower surface of the base part coming in contact with the second surface, and the upper surface of the base part coming in contact with the third surface, at least two third engagement portions having a contact surface that is substantially perpendicular to an axial direction of the crankshaft are formed on the lower surface of the base part, at least two fourth engagement portions, respectively, and each having a contact surface that is substantially perpendicular to the axial direction of the crankshaft are formed on the second surface, the contact surfaces of the third engagement portions and the contact surfaces of the fourth engagement portions each includes two contact surfaces that are parallel to each other, and when one of the contact surfaces of the at least two of the third engagement portions forming the lower surface of the base part come in contact with one of the contact surfaces of the fourth engagement portions formed on the second surface on one side in the axial direction of the crankshaft, the core supporting step including the other of the contact surfaces of the at least two of the third engagement portions coming in contact with the other contact surface of the fourth engagement portions on the other side in the axial direction of the crankshaft, and a molten metal injection step in which the casting mold is closed and molten metal is injected into the cavity.

14. The cylinder head casting method according to claim 13, wherein the lower die includes an insert having the first surface that corresponds to the opening surface of the ports on the combustion chamber side and a mother die to which the insert is fitted.

15. A cylinder head casting method for casting a cylinder head of an internal combustion engine having a crankshaft and a plurality of cylinders that each includes a plurality of ports for air intake or exhaust, the cylinder head casting method comprising:

a casting mold comprising an upper die, a lower die, and side dies that relatively approach and move away from each other so as to define a cavity inside that corresponds to the outer shape of the cylinder head, the lower die having a first surface that corresponds to an opening surface of the ports on a combustion chamber side and a second surface that faces a lower surface of a base part of a casting core, and the side dies having a third surface that faces the second surface, a preparation step for preparing the casting core that is supported in the cavity and that includes a plurality of body parts having outer shapes that respectively correspond to the plurality of ports, and a base part that is integrally formed at the proximal end sides of the plurality of body parts, a core supporting step in which the casting core is configured such that the body parts are supported in the cavity by distal ends of the body parts coming in contact with the first surface, the lower surface of the base part coming in contact with the second surface, and the upper surface of the base part coming in contact with the third surface, the internal combustion engine comprising three or more cylinders, at least two fifth engagement portions having a contact surface that is substantially perpendicular to an axial direction of the crankshaft are formed on the first surface that corresponds to second body parts other than first body parts that correspond to the cylinders positioned at least the two ends of the cylinder, at least two sixth engagement portions fitted to the fifth engagement portions, respectively, and each having a contact surface that is substantially perpendicular to the axial direction of the crankshaft are formed at the distal ends of the second body parts, the contact surfaces of the fifth engagement portions and the contact surfaces of the sixth engagement portions each includes two contact surfaces that are parallel to each other, and when one of the contact surfaces of the at least two of the sixth engagement portions formed at the distal ends of the second body parts come in contact with one of the contact surfaces of the fifth engagement portions formed on the first surface on one side in the axial direction of the crankshaft, the core supporting step including the other of the contact surfaces of the at least two of the sixth engagement portions coming in contact with the other of the contact surfaces of the fifth engagement portions on the other side in the axial direction of the crankshaft, and a molten metal injection step in which the casting mold is closed and molten metal is injected into the cavity.

16. The cylinder head casting method according to claim 15, wherein the lower die includes an insert having the first surface that corresponds to the opening surface of the ports on the combustion chamber side and a mother die to which the insert is fitted.

* * * * *